US007211001B2

(12) United States Patent
Motyka et al.

(10) Patent No.: US 7,211,001 B2
(45) Date of Patent: May 1, 2007

(54) PERSONAL PROTECTION SYSTEM

(75) Inventors: John Motyka, 399 Dogford Rd., Etna, NH (US) 03750; Bruce E. McCoy, South Royalton, VT (US)

(73) Assignee: John Motyka, Langhorne, PA (US)

( * ) Notice: Subject to any disclaimer, the term of this patent is extended or adjusted under 35 U.S.C. 154(b) by 0 days.

(21) Appl. No.: 11/269,216

(22) Filed: Nov. 8, 2005

(65) Prior Publication Data

US 2006/0097007 A1 May 11, 2006

Related U.S. Application Data

(63) Continuation-in-part of application No. 10/626,188, filed on Jul. 24, 2003, now abandoned.

(51) Int. Cl.
*F41B 15/02* (2006.01)

(52) U.S. Cl. ..... 463/47.2

(58) Field of Classification Search ..... 463/47.2–47.4; 42/1.09, 1.16, 52; 220/480, 481; 224/400, 224/914; 248/682, 560, 511, 534, 65, 200, 248/200.1, 218.4, 219.1–219.4, 251
See application file for complete search history.

(56) References Cited

U.S. PATENT DOCUMENTS

| | | | | |
|---|---|---|---|---|
| 465,949 | A | 12/1891 | Roovers et al. | |
| 4,093,969 | A | 6/1978 | Maynor, Jr. | |
| 4,498,204 | A * | 2/1985 | Warner | 4/559 |
| 4,962,779 | A | 10/1990 | Meng | |
| 5,022,104 | A | 6/1991 | Miller | |
| 5,041,951 | A | 8/1991 | Fan | |
| 5,086,377 | A | 2/1992 | Roberts | |
| 5,242,349 | A | 9/1993 | Reiff et al. | |
| 5,282,332 | A | 2/1994 | Philips | |
| 5,388,603 | A | 2/1995 | Bauer et al. | |
| 5,509,904 | A | 4/1996 | Kilham | |
| 5,635,908 | A | 6/1997 | Soper | |
| 5,709,635 | A | 1/1998 | Denison | |
| 5,826,847 | A * | 10/1998 | Warner et al. | 248/354.1 |
| 5,839,461 | A | 11/1998 | Lambeth, Jr. | |
| 5,842,601 | A | 12/1998 | Pierpoint | |
| 5,901,723 | A | 5/1999 | Ames | |
| 6,367,724 | B1 * | 4/2002 | Atkinson et al. | 242/118.11 |
| 2002/0108966 | A1 | 8/2002 | Park | |
| 2004/0220031 | A1 * | 11/2004 | Blacker | 482/148 |

* cited by examiner

*Primary Examiner*—William M. Pierce
(74) *Attorney, Agent, or Firm*—Michael J. Weins; Jeffrey E. Semprebon

(57) ABSTRACT

A personal protection system has a shaft that can be secured into a pair of end bases that mount to a surface of the surroundings of the user. The shaft and bases are configured to appear as a natural part of the surroundings, such as a support bar or rail, when the shaft is stored. The shaft can be removed, and has an end portion adapted to provide a weapon for self defense. For example, the end portion can employ a piercing point, a syringe and needle for injecting a bio-toxin, a canister for spraying a chemical irritant, an appliance for generating an electrical shock, or combinations of these elements. Preferably, the shaft is secured into the bases so as to be usable for support. It is further preferred for the bases to be configured to disguise the fact that the shaft can be removed.

20 Claims, 11 Drawing Sheets

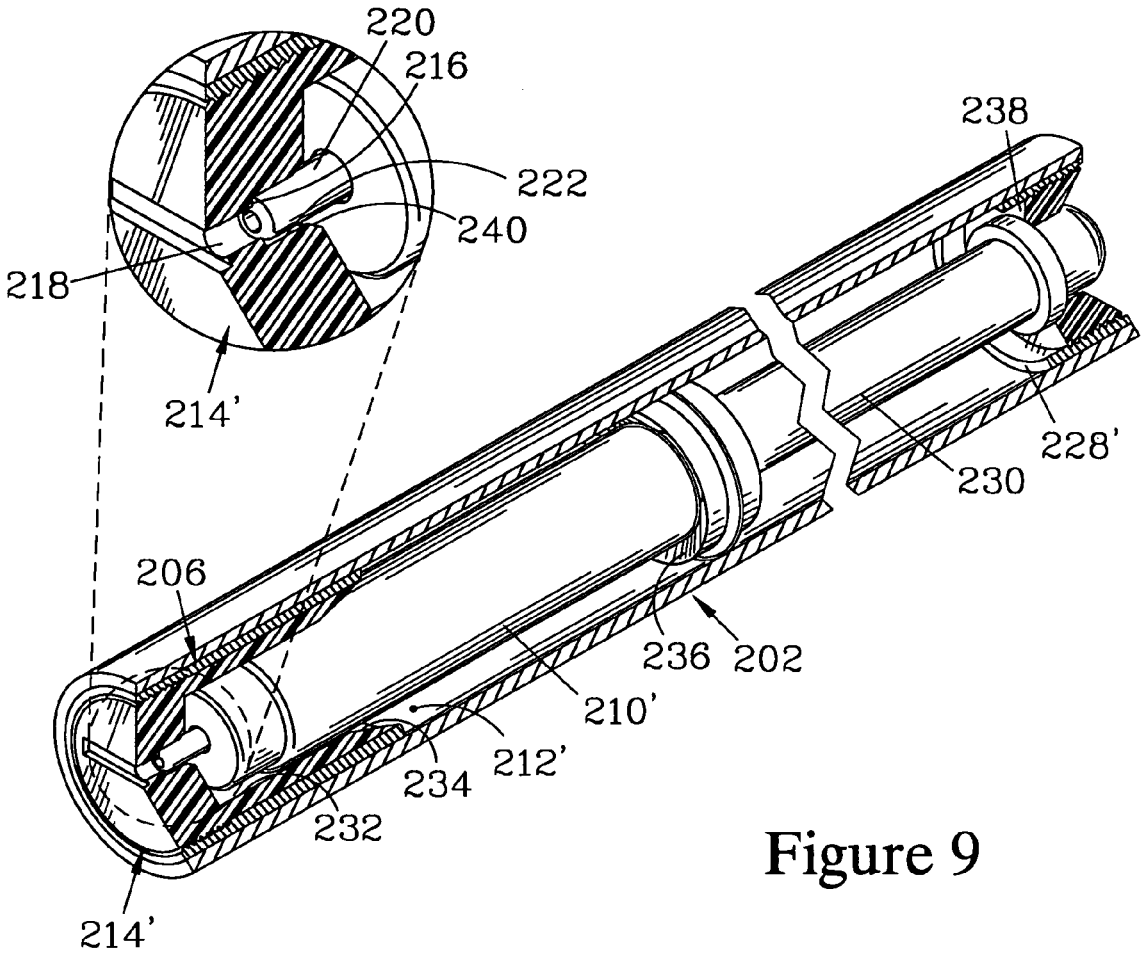
Figure 9
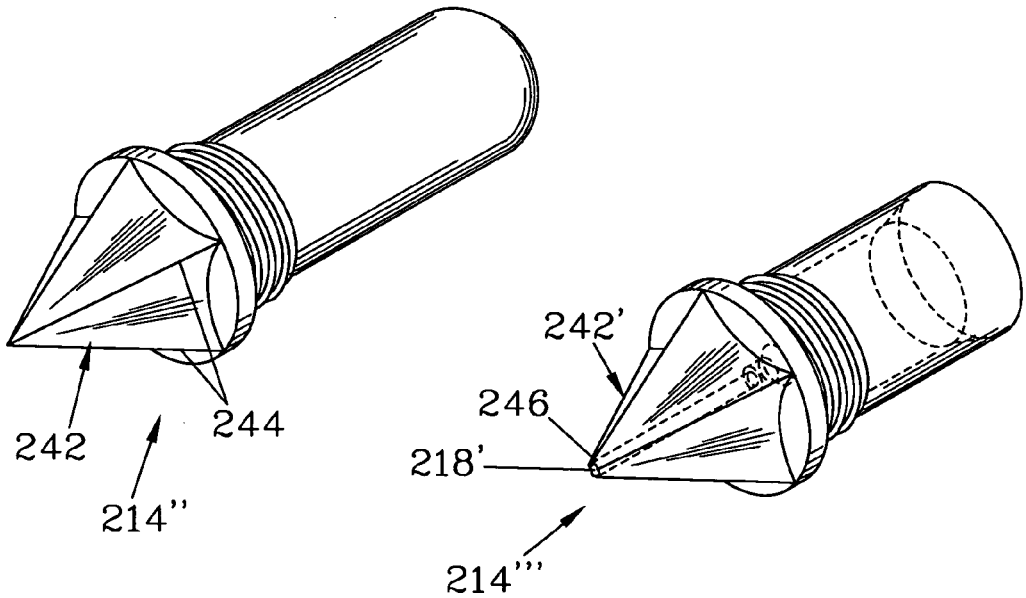

PERSONAL PROTECTION SYSTEM

TECHNICAL FIELD

The present invention relates to a deterrent or self-defense device which is stored in an environment and, in some situations, becomes a functional part thereof. More particularly, the device is configured such that, when stored, it blends in with the environment and becomes part of the background such that its potential for self-defense use is not noted by others.

BACKGROUND OF THE INVENTION

There are a variety of personal protection devices which are currently available which disguise a self-defense device in another object which has separate utility; the disguise is intended to provide the user with the advantage of surprise if attacked, since an aggressor will hopefully assume the user to be unarmed. Examples of such disguised devices are canes/umbrellas and dumbbells. However, these devices are freestanding and the conventional objects that these devices resemble are objects that provide a degree of defense use. Canes, for example, have frequently been used to ward off an aggressor, and the weight and mass of a dumbbell serves as an extension of the hand and makes the hand a more effective fighting tool when gripped. Thus, the advantage of surprise is greatly diminished, since an attacker will appreciate that a cane or dumbbell may be used as an improvised weapon and will plan their attack accordingly.

Furthermore, these devices most likely can only be used as a defense device if they are being carried by the user at the time an aggressor makes their advance. An aggressor would be quick to the thwart a person from moving to and picking up any device which the attacker would appreciate could be used as a defensive aid.

Thus, there is a need for a defensive device which can be concealed in the environment which surrounds the user, readily accessible by the user but the presence of which will not be recognized by an aggressor.

SUMMARY OF THE INVENTION

The present invention is for a personal protection system to assist a user in warding off an aggressor when the aggressor enters the surroundings where the user is operating. The personal protection system has an elongated shaft and a pair of end bases in which the shaft can be removably engaged, the personal protection system mounting to a surface of the surroundings in which the user is operating and being configured to appear as a natural part of the surroundings. The end bases and the shaft are configured such that, when the shaft is engaged with the end bases, the shaft appears to be a conventional fixture such as a grab bar or a hand rail that one might expect to find in that location. For example, when such a personal protection system is intended for use in a bathroom environment, it could take the form of a shower curtain rod, a towel rack, or a safety bar for incorporation into a shower or tub enclosure. For other applications, the shaft and bases might form part of a grab bar or a handrail for a boat, a bus, an airplane, a kitchen or galley, a hallway, or a gymnasium.

The shaft of the personal protection system has a longitudinal shaft axis, a first end portion that is adapted to be held by a user, and a second end portion adapted to form a prod. The shaft itself can serve as a club or truncheon, with the blunt end having utility as a prod. Having a pointed end will enhance its effectiveness, and having a cutting or piercing end will further serve to deter an aggressor.

In the case where the prod is designed to puncture the aggressor, it is preferred that the second end portion be provided with a syringe for injection of a bio-toxin, defined herein as a chemical agent which can impair or incapacitate a person to whom the agent is applied so as to prevent further aggressive action by that person.

It is frequently desirable to employ prods that are more aggressive than prods that have contact ends for applying pressure to cause discomfort, but which are less aggressive than prods with piercing or cutting surfaces. Such prods include those which employ an appliance for providing a deterrent. Typical examples of such appliances include means for projecting chemical deterrents such as pepper sprays, gases or gels, and devices for generating an electrical discharge. In such embodiments, the shaft is provided with means for housing the appliance, means for communicating the deterrent through and beyond the second end portion of the shaft, and means for activating the deterrent.

When a chemical agent is used as a deterrent, the agent is frequently released from a canister through a nozzle when a nozzle release mechanism is activated, the agent being generally directed along a nozzle axis. When such a canister is employed, the shaft includes a chamber that houses the canister, the chamber preferably being aligned with the shaft axis and positioned in the vicinity of the second end portion of the shaft. The chamber terminates with a second end block that is configured to engage the nozzle. The second end block also has a block passage configured to communicate with the nozzle such that the chemical agent released from the nozzle will be directed through the block passage. To aid the user in directing the chemical agent at the aggressor, it is preferred to provide means for maintaining alignment of the nozzle axis with the shaft axis. When the nozzle is axially aligned with the canister, means for maintaining the alignment of the nozzle axis with the shaft axis can be provided by employing a canister that slidably engages at least a portion of the chamber. When only a portion of the chamber is sized to match the canister, the chamber may have a conical ramp surface to guide the canister into the portion which is matched in size, and the canister can be further aligned by providing a concave conical rear surface of the chamber for engagement with the canister.

When a canister such as described above is employed, means for activating the nozzle release mechanism are provided. Typically, the chemical agent is released when there is axial motion of the nozzle with respect to the canister. In such cases, the means for activating the nozzle mechanism is preferably provided by means for moving the chamber rear surface, thereby advancing the canister in the chamber toward the second end block while the engagement of the nozzle with the second end block serves to maintain the nozzle in position. Advancement of the canister is preferably accomplished by providing a slidably engaged activating rod having a head that defines the chamber rear surface. In a preferred embodiment, the activating rod has a free end that extends through the first end portion of the shaft so as to be manually operated.

When the deterrent appliance provides an electrical discharge, the second end portion of the shaft incorporates a pair of electrodes and an electrical discharge circuit for generating a high voltage therebetween. The electrical discharge circuit, in turn, is powered by a battery, both these elements being housed in the shaft. The electrodes extend through and protrude from the second end block and serve as means for communicating the deterrent. A switch in the first end portion of the shaft provides the means for activating the deterrent. In this location, the switch is positioned so that it is concealed when the shaft is engaged in the end bases.

The pair of end bases of the personal protection system include a first end base for attachment to the surface of the surroundings. The first end base has a first base aperture configured to accept the first end portion of the shaft. A second end base is also provided, for attachment either to the same surface as the first end base or to another surface of the surroundings. The second end base has a second base aperture configured to accept the second end portion of the shaft; thus, the first end base and the second end base should be mounted such that the base apertures face each other and are aligned to accept the shaft. To assure that the countermeasure system is not recognized by an intruder/aggressor, the shaft, the first end base and the second end base are configured so as to form a natural-appearing extension of the surface when the end portions are accepted in the base apertures, so as to become part of a background in which the user is operating.

Means for engaging and disengaging the end portions of the shaft in the first end base and the second end base are provided. These means are designed such that, when so engaged, the shaft and the bases transition so as not to interrupt the continuity of the background. It is preferred that the shaft and bases should function in the same manner as the background fixture which they resemble. For example, when the shaft and bases provide the appearance of a safety bar or handrail, the shaft should securely engage the bases so that the combined shaft and bases can function as a safety bar or handrail to provide support when grasped by the user. To accomplish this functionality, it is preferred to provide means for lockably engaging at least one of the end portions with its associated base. When the shaft is lockably engagable with one of the end bases, the end base is preferably configured so as to conceal the means for lockably engaging the shaft.

The means for engaging and disengaging the shaft in the end bases allow the shaft to be removed by deliberate action on the part of the user. Typically, the shaft is advanced further into one of the base apertures to allow the other end to be freed from its associated base aperture; the shaft can then be disengaged from the base into which it was advanced. Frequently, one of the end portions of the shaft is pivotable when accepted into the corresponding base aperture, allowing the other end portion to be swung past its associated end base when the shaft is advanced. Alternatively, the shaft may have sufficient flexibility to allow the other end to be bent away from its associated end base.

BRIEF DESCRIPTION OF THE FIGURES

FIG. 9 is an isometric view of a shaft which shares many parts in common with the shaft shown in FIG. 8, but which has a second end block configured to provide alignment for a smaller diameter canister of chemical deterrent; alignment of the canister and the nozzle is provided by a chamber support surface on the second end block, which is configured to define a portion of the chamber that is sized to be slidably engaged by the canister, in combination with a conical chamber rear surface formed on an activating rod. FIG. 9 also shows two alternative second end blocks which can be employed; one second end block provides a tip point which provides sharp edges capable of cutting the aggressor if jabbed or slashed with sufficient force, while another second end block provides a pointed tip as well as serving to align a canister of chemical deterrent.

In FIG. 21, the hand rail is shown mounted in an airplane cabin and is positioned to blend in with the airplane cabin environment.

DETAILED DESCRIPTION OF THE PREFERRED EMBODIMENTS

Figure 1:
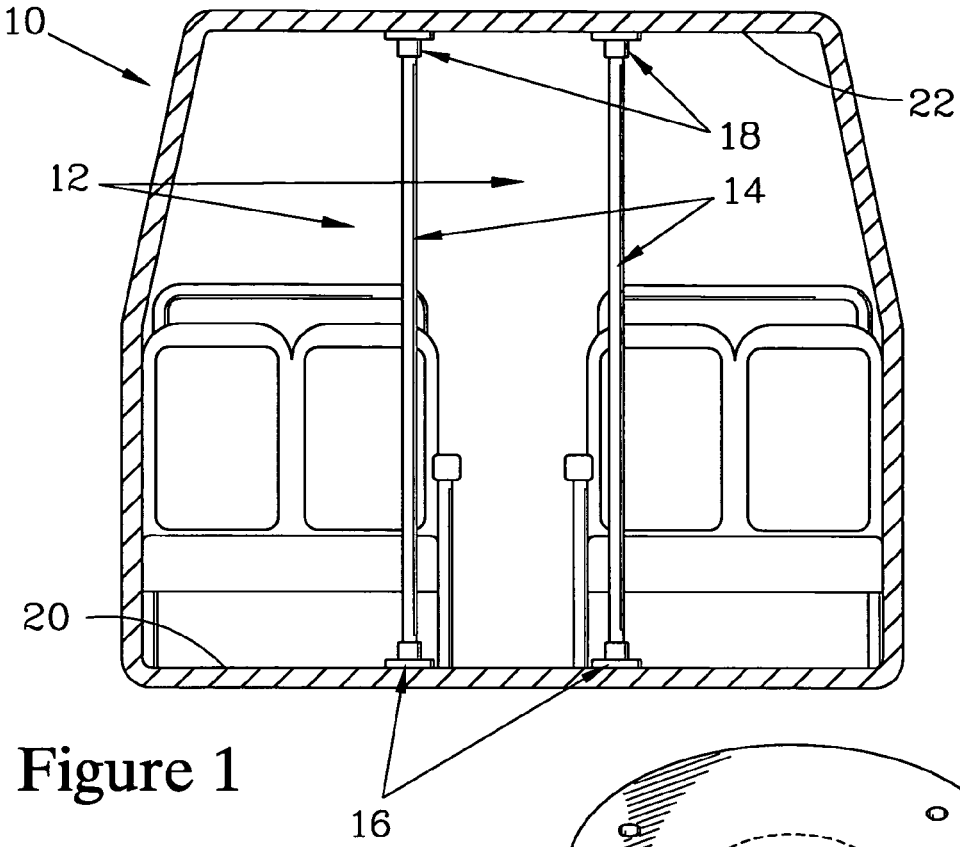
FIG. 1 is a section view of a public transit vehicle, such as a subway car, wherein two personal protection systems are formed by vertical bars and associated bases that provide stabilizing support for standing passengers.

FIG. 1 is a schematic section view of a public transit vehicle 10 such as a subway car, commuter train car, or a bus which is fitted with a pair of personal protection systems 12 of the present invention. The personal protection systems 12 provide vertical shafts 14 which, in normal service, provide grab bars and thus blend into the environment where public transit personnel are working. The vertical shafts 14 are in turn each mounted in a first end base 16, which serves as a lower base, and a second end base 18, which serves as an upper base. The end bases (16, 18) attach respectively to a floor surface 20 and to a ceiling panel 22 of the vehicle 10. The personal protection systems 12 are not only a natural part of the environment inside the public transit vehicle 10, but also provide a support function to passengers. This is done while still allowing a conductor or other public transit personnel to remove one of the shafts 14 from the associated bases (16, 18) and use the shaft 14 as a deterrent to a ward off an aggressor. When the vertical shafts 14 are to be employed by riders to provide support when standing, it is critical that means be provided to avoid loosening of the shafts 14 in service; such means are discussed below. It may also be that catches can be provided that could only be released by service personnel; for example, one option might be an electromagnetic catch that could be remotely operated by authorized personnel, such as by a radio-activated device or a wired controller. Also, hand-held devices similar to the bobs carried on key chains for locking and unlocking automobile doors might be used, as discussed below with regard to FIG. 18.

Figure 2:
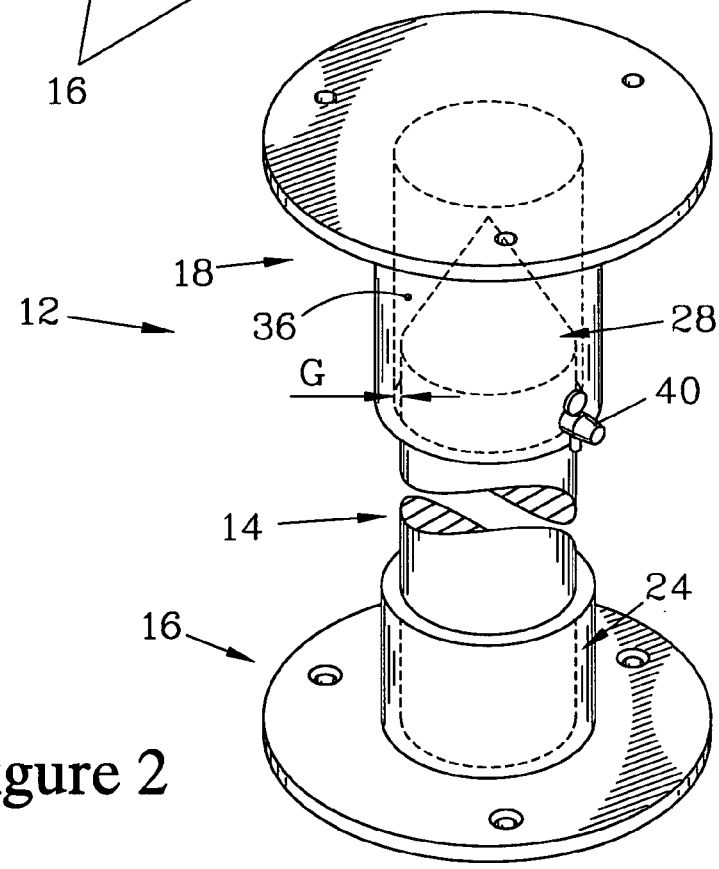
FIG. 2 is an isometric view of one the shafts and associated bases shown in FIG. 1.
Figure 3:
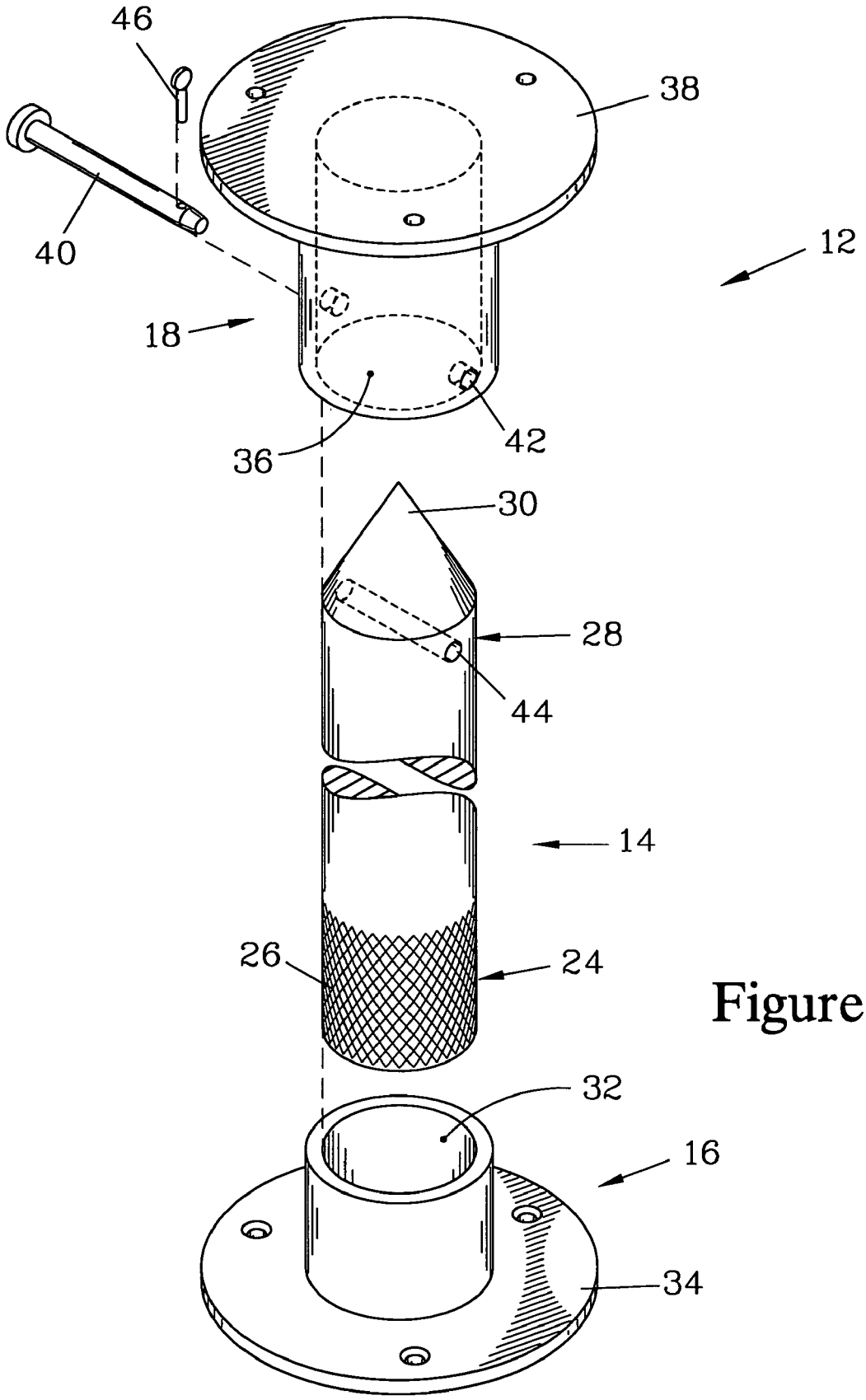
FIG. 3 is an exploded isometric view of the shaft and bases shown in FIG. 2. In this embodiment, the shaft has a first end portion which is knurled to provide a gripping surface, and a second end portion which is formed with a pointed tip so as to prod a potential aggressor, thereby turning away the aggressor's advances.

FIGS. 2 and 3 illustrate one of the personal protection systems 12 shown in FIG. 1 in greater detail. FIG. 2 is a view of the assembled personal protection system 12, while FIG. 3 is an exploded view. In this embodiment, the shaft 14 has a first end portion 24 which is designed to be gripped by the user when being used to fend off an aggressor. Preferably, the first end portion 24 has a gripping surface 26 such as knurling to improve the control of the shaft 14 by the user. The gripping surface 26 should be concealed when the shaft 14 is stored to avoid providing notice that the grab bar differs from conventional bars. A second end portion 28 of the shaft 14 is adapted to form a prod; in this embodiment, the prod is a spear point 30 which can be used to jab at an aggressor.

As shown in FIG. 3, the first base 16 has a first base aperture 32 which is configured to slidably engage the first end portion 24 of the shaft 14. The first base 16 terminates in a first base mounting flange 34 which is designed for coupling the floor surface 20 of the public transit vehicle 10 (shown in FIG. 1).

The second base 18 has a second base aperture 36 which is configured to accept the second end portion 28 of the shaft 14. When the first base aperture 32 is configured so as to slidably engage the first end portion 24 of the shaft 14, then the configuration of the second base aperture 36 must be sufficiently oversized with respect to the second end portion 28 that such that the shaft 14 can be tilted to a sufficient degree that, when advanced into the second base aperture 36 a sufficient distance to free the first end portion 24 from the first base aperture 32, the first end portion 24 can be moved out of alignment with the first base 16 and slid past it so as to allow removal of the second end portion 28 from the second base 18. This oversizing of the second base aperture 36 results in a gap G (shown in FIG. 2) between the second end portion 28 and the second base 18, which creates a somewhat unnatural appearance to the astute observer; this gap can be overcome with more refined embodiments, as is discussed below. Again, the second base 18 terminates in a second base mounting flange 38 which is designed to be attached to the ceiling panel 22 of the public transit vehicle 10 (shown in FIG. 1).

In this embodiment, the shaft 14 is locked into position by a pull pin 40 which is designed to pass through a second base passage 42 and a shaft second end passage 44; a lock pin 46 is provided to secure the pull pin 40 in the passages (42, 44). While a pull pin is illustrated for lockably engaging the shaft 14 with the second base 18, it is preferred for the locking means to be concealed to preserve the disguise of the personal protection system 12; such concealed locking means are discussed below.

Figure 4:
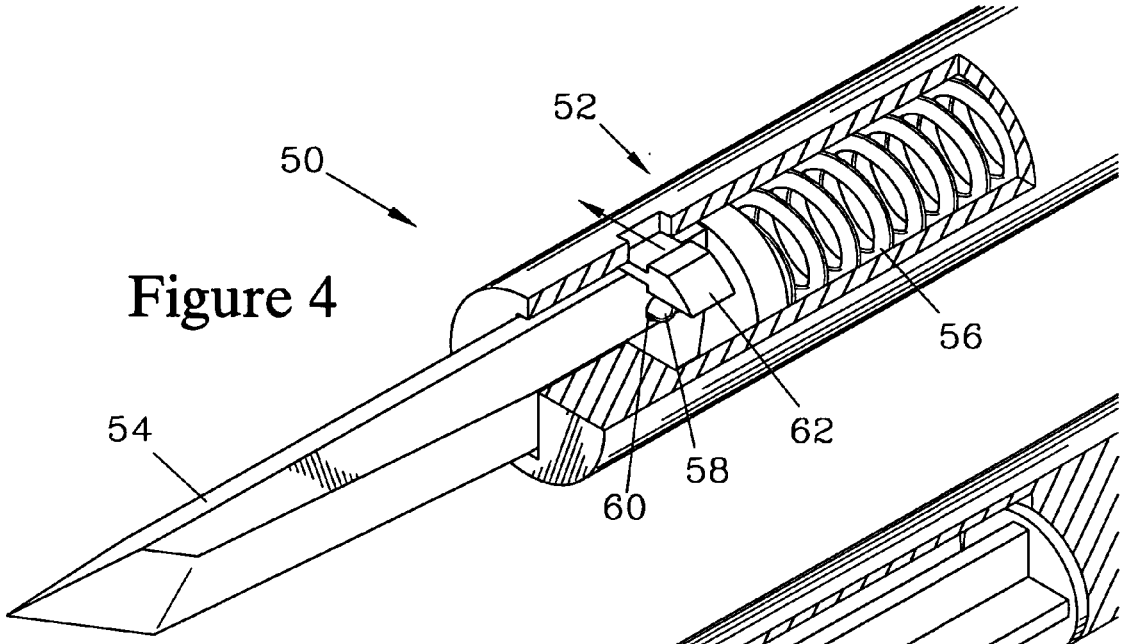
FIG. 4 is an isometric view of a second end portion of a shaft of an aggressive personal protection system which prods the aggressor with a blade that is capable of piercing and cutting the aggressor.

FIG. 4 is a partial view of a shaft 50 having a shaft second end portion 52 that is more aggressive than the second end portion 28 discussed above. In this embodiment, rather than using a spear point to be poked at an aggressor, the shaft second end portion 52 is provided with a knife blade 54 to allow the user to slash at the aggressor as well as pierce the aggressor. The knife blade 54 is retractable so that the shaft second end portion 52 can be readily stored in a second end base (not shown). The knife blade 54 is biased by a blade spring 56 so as to extend from the shaft second end portion 52 when the shaft second end portion 52 is withdrawn from the second end base, and is maintained in the extended position by a spring-loaded catch 58 that engages a blade catch passage 60. To retract the knife blade 54 in order to return the shaft 50 to its stored position engaged with the end bases, a release button 62 on the shaft 50 is pushed to disengage the catch 58 from the blade catch passage 60, allowing the knife blade 54 to be retracted as the shaft second end portion 52 is inserted into a second base aperture of the second end base.

Figure 5:
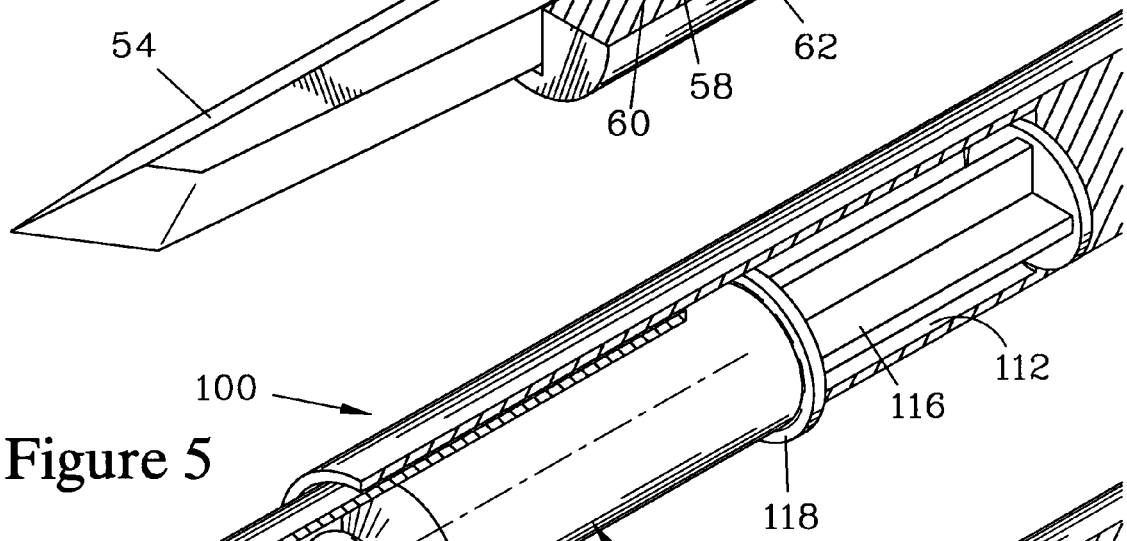
FIGS. 5 and 6 are isometric views of another aggressive personal protection system of the present invention, where an invasive prod is employed and is mounted in the second end portion of the shaft. In this embodiment, a needle and an associated syringe are provided. The syringe can be filled with a bio-toxin which can be injected into the aggressor.
Figure 6:
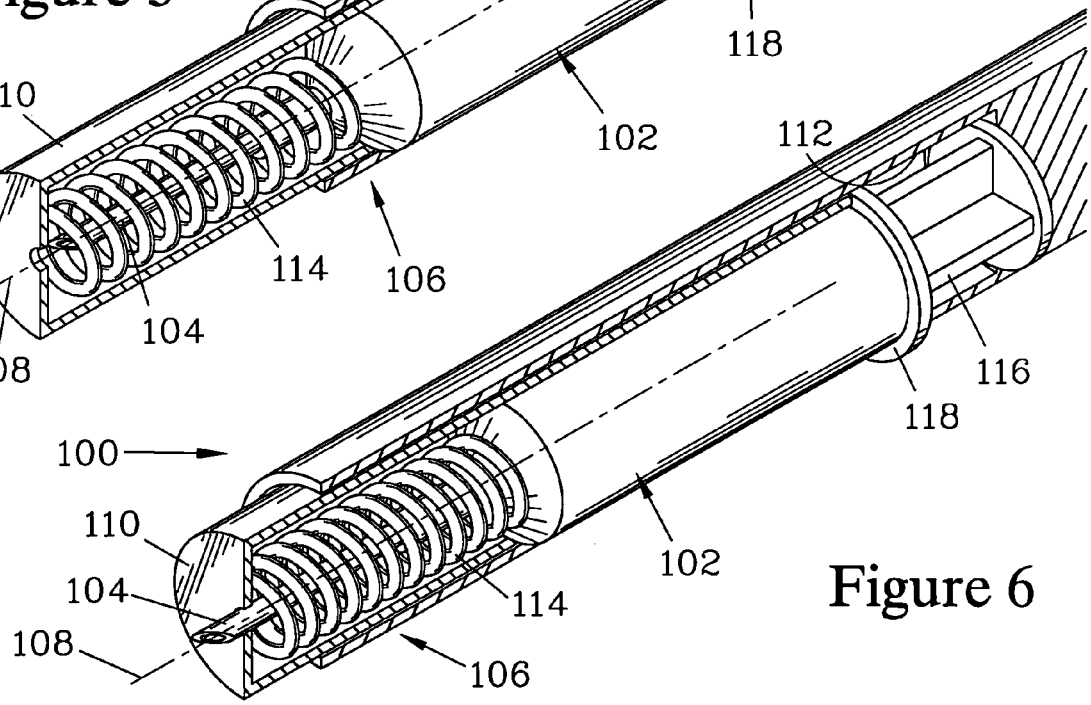

FIGS. 5 and 6 illustrate a section of another shaft 100, which differs from the shafts 14 and 50 discussed above in that the prod incorporates a syringe 102 and a needle 104 mounted in a second end portion 106 of the shaft 100. The syringe 102 and the needle 104 are mounted parallel to a longitudinal shaft axis 108, and reside in a telescoping section 110 of the second end portion 106. The telescoping section 110, which slidably engages the syringe 102 as well as a sidewall 112 of the shaft 100, will collapse when pushed against the body of an aggressor, providing means for mounting the needle 104 and the syringe 102 such that the needle 104 is extendable beyond the second end portion 106. The collapse has a first stage, where the telescoping section 110 collapses against the pressure of a biasing spring 114 so as to expose a portion of the needle 104. In order to assure that this occurs without ejecting fluid from the syringe 102, it is necessary that the resistance of a plunger 116 to sliding in the syringe 102 be substantially greater then the force supplied by the spring 114. As shown in FIG. 6, a second stage of telescoping occurs when the telescoping section 110 contacts a rim 118 on the syringe 102 and pushes the syringe 102 so as to advance the plunger 116 into the syringe 102, thereby providing means for injecting the contents of the syringe 102 through the needle 104. Preferably, the syringe 102 contains a bio-toxin which can quickly disable an aggressor. Some examples of substances which might serve as injected bio-toxins would include poisons, sleep-inducing drugs, disorienting drugs, and muscle-relaxing drugs.

For many applications, it is desirable for the shaft to employ a prod which is not so aggressive as to puncture the aggressor, but which provides greater deterrent capability than a simple pointed end. For such applications, it is frequently desirable to employ conventional appliances for generating a deterrent. Two examples of such appliances that have been classically used for self-defense and deterring aggression are devices which discharge a chemical irritant and devices which generate a high-voltage electrical discharge. Examples of shafts of the present invention which incorporate such deterrent-generating appliances are described below.

Figure 7:
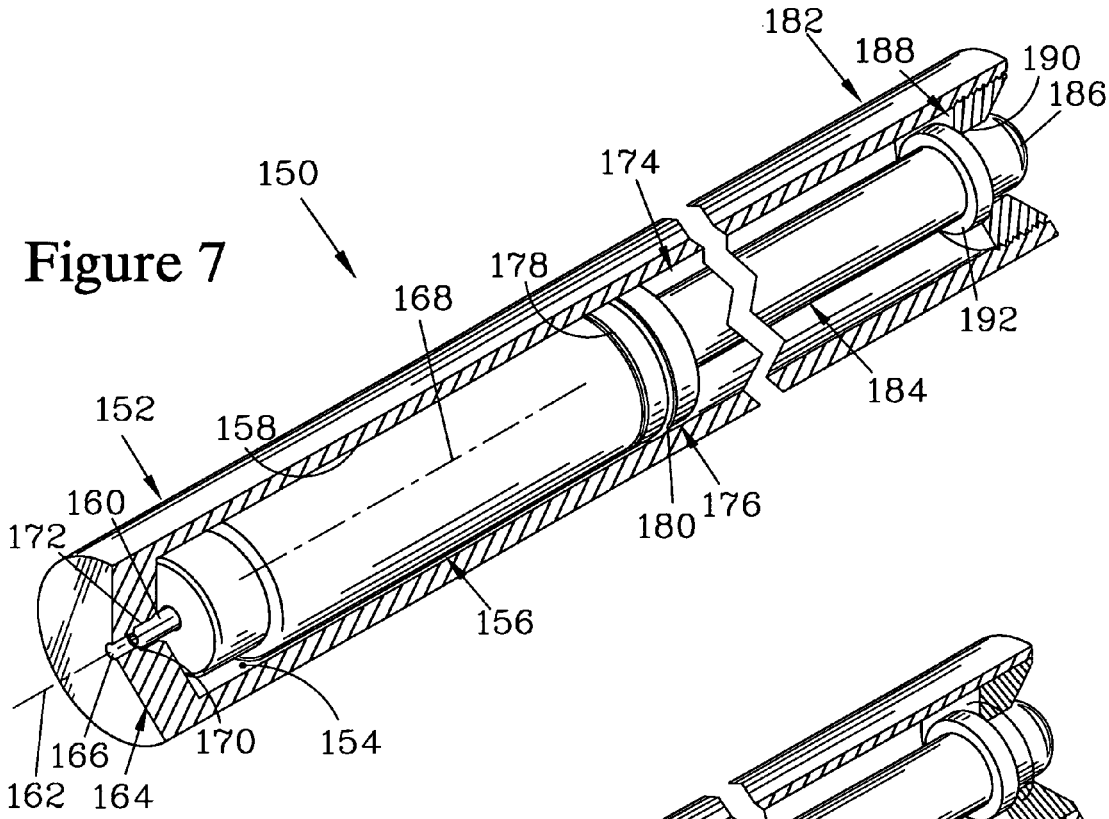
FIG. 7 is a section view of a shaft of another embodiment of a personal protection system of the present invention, which is more aggressive than the contact prod shown in FIGS. 2 and 3, but less aggressive than the invasive prods of the embodiments illustrated in FIGS. 4-6; in this embodiment, the shaft has a second end portion that houses a canister of a chemical spray irritant to inhibit the advance of an aggressor. The irritant is released from the canister as it is moved toward the second end portion of the shaft by an activating rod that extends along the shaft and through a first end portion of the shaft. In this embodiment, alignment of the canister and nozzle with the shaft is maintained by the use of a canister that slidably engages a chamber in the second end portion.

FIG. 7 illustrates a shaft 150, which differs from the shafts (14, 50, 100) discussed above in that it has a second end portion 152 that is provided with a chamber 154 for housing a canister 156 filled with a pressurized chemical irritant. The chamber 154 has a sidewall 158 configured to be slidably engaged by the canister 156. The canister 156 can be sprayed to stop the advance of an aggressor; in this embodiment, the irritant is gaseous when sprayed. The canister 156 has an associated nozzle 160 with a valve (not shown) which is opened when the nozzle 160 is advanced into the canister 156. The nozzle 160 has a nozzle axis 162 along which the spray is directed. The second end portion 152 terminates at a second end block 164 having a block passage 166 therethrough. In this embodiment, the second end block 164 is formed as an integral part of the shaft 150. The block passage 166 is symmetrically disposed about a shaft axis 168. The second end block 164 is also formed with a nozzle seat 170 which abuts the block passage 166 and is configured to engage the nozzle 160 so as to limit its longitudinal motion. The second end block 164 is preferably also formed with a nozzle recess 172 that is configured to accept the nozzle 160 and limit off-axis movement of the nozzle 160.

An activating rod 174 is provided, which has a rod head 176 that is configured to slidably engage the sidewall 158 of the chamber 154 so that it can be brought into engagement with the canister 156; a chamber rear surface 178 on the rod head 176 serves to terminate the chamber 154. An O-ring 180 is provided on the rod head 176 to sealably engage the sidewall 158 to prevent any chemical irritant from blowing back toward a first end portion 182 of the shaft 150. The O-ring 180 also serves to maintain the rod head 176 axially aligned with the shaft 150, and should be sized so as to avoid excessive friction against the sidewall 158 to allow the activation rod 174 to be advanced without undue resistance.

The activation rod 174 has a rod shank 184 terminating in a rod free end 186 that slidably engages and passes through a first end cap 188 that terminates the first end portion 182 of the shaft 150. A first end passage 190 in the first end cap 188 is configured to slidably engage and support the rod shank 184 so as to help maintain the activating rod 174 axially aligned with the shaft 150. A rod retaining ring 192 on the rod shank 184 limits the extension of the activating rod 174 from the first end cap 188; the rod free end 186 should not extend beyond the shaft 150 to prevent accidental discharge of the canister 156 when the first end portion 182 is inserted into a first end base (not shown). When the user pushes on the rod free end 186, the activating rod 174 pushes on the canister 156; since the nozzle 160 engages the nozzle seat 170, it cannot move with the canister 156 and is forced inward, opening the valve to release the irritant spray through the block passage 166.

In this embodiment, the canister 156 can be replaced by removing the first end cap 188, which is threadably engaged with the first end portion 182, and removing the activating rod 174. A new canister 156 can then be inserted into the chamber 154. The nozzle 160 should be axially aligned with the shaft axis 168 to assure that the spray is directed through the block passage 166. In this embodiment, axial alignment of the nozzle 160 is achieved by making the sidewall 158 closely sized to the canister 156 to guide it when it is inserted into the shaft 150. The nozzle recess 172 is preferably chamfered to allow the nozzle 160 to be readily inserted therein. Additionally, the chamber rear surface 178 that applies force to advance the canister 156 should be longitudinally positioned such that the activating rod 174 requires minimal movement to advance the canister 156 to release the chemical agent. Longitudinal positioning of the chamber rear surface 178 can be adjusted by having the rod head 176 threadably mounted to the rod shank 184, allowing the effective length of the activating rod 174 to be adjusted.

Figure 8:
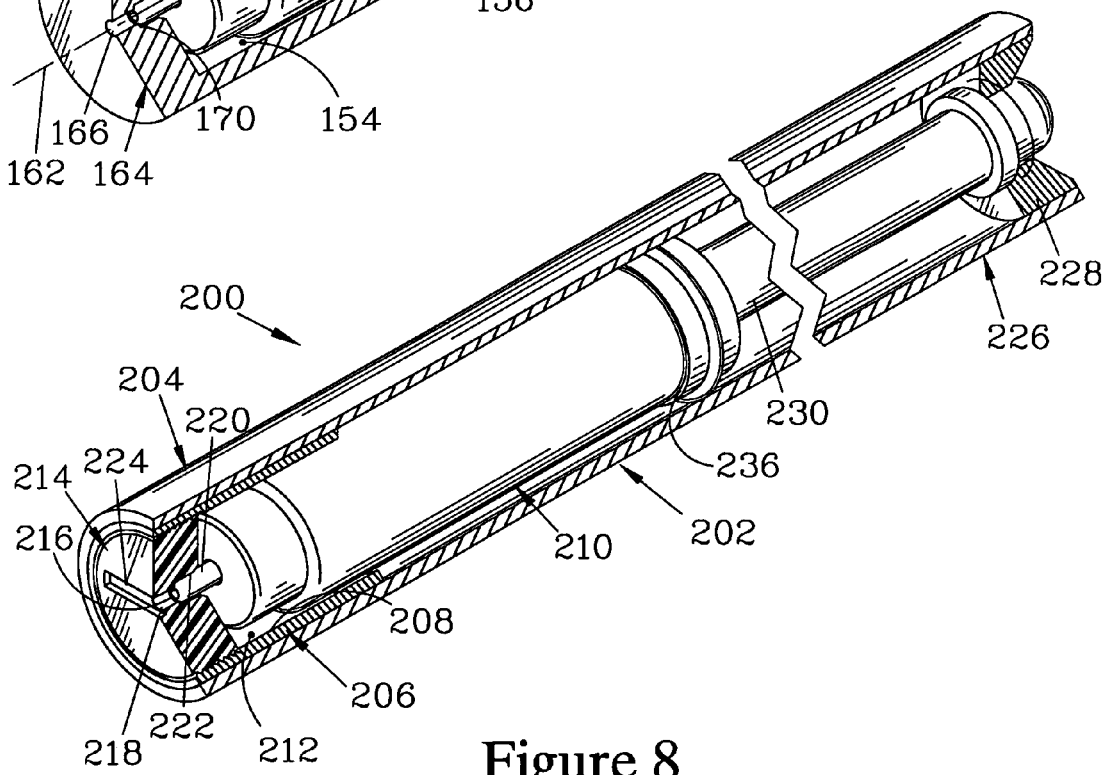
FIG. 8 is an isometric view of an alternative embodiment to that of FIG. 7 that performs the same function, but which employs a shaft that is fabricated from a tube rather than from a solid bar having a cavity formed therein. The tube which serves as the shaft has, in its second end portion, a second end insert configured to be slidably inserted into the shaft and, in turn, to slidably engage the canister of chemical deterrent. A second end block having a block passage is threaded into the second end insert and can be removed to replace the canister. A first end insert is also slidably inserted into the tube, and has a rod passage configured to slidably engage and support the activating rod.

FIG. 8 is an isometric view of an alternative embodiment to that of FIG. 7 that performs the same function, but which employs a shaft 200 that is fabricated using a tube 202 rather than being machined from a solid bar. The tube 202 has a second end portion 204 that is provided with a second end insert 206 having an outer diameter such that it can be slidably inserted in the tube 202. The second end insert 206 could be press fitted into the tube 202, but more preferably is secured in the second end portion 204 by an adhesive to reduce the need for precision machining and to accommodate variation in the size of the tube 202. The second end insert 206 has a chamber sidewall 208 sized such that a canister 210 of chemical deterrent will slidably engage the second end insert 206. The chamber sidewall 208 defines, in part, a chamber 212 in which the canister 210 is housed.

A second end block 214 is provided, having a nozzle seat 216 and a block passage 218, through which the chemical agent in the canister 210 can be discharged. In this embodiment, the second end block 214 is not formed as an integral part, but instead threadably secures into the second end insert 206. The nozzle seat 216 is configured to engage a nozzle 220 on the canister 210, and the second end block 214 is preferably formed with a nozzle recess 222 configured to support the nozzle 220. Preferably, the threadable engagement of the second end block 214 with the second end insert 206 is such as to resist turning; such can be readily provided by forming the second end block 214 of a plastic which is slightly compressed as it threadably engages the second end insert 206. The second end block 214 illustrated has a screwdriver slot 224 that can be engaged by a conventional screwdriver to allow the second end block 214 to be unscrewed to provide access to the chamber 212 to replace the canister 210. The second end insert 206 allows the tube 202 to be relatively thin-walled, since the tube 202 itself is not threaded, without compromising the support function of the shaft 200 when secured in a pair of end bases (not shown).

The shaft 200 also has a first end portion 226 which has a first end insert 228 that is inserted into the tube 202 and secured therein, again preferably by use of an adhesive. The first end insert 228 serves to retain and support an activating rod 230 that extends within the shaft 200. Since the activating rod 230 is closely sized to the tube 202, it must be inserted into the tube 202 before the inserts (206, 228) are both secured into the tube 202. Alternatively, an activating rod having an expandable head could be employed.

FIG. 9 is an isometric view of an embodiment which shares many parts in common with the embodiment shown in FIG. 8, but which is intended for use with a canister 210' which is smaller in diameter than the canister 210. In this embodiment, a second end block 214' is threadably secured into the second end insert 206. The second end block 214' is provided with a chamber support surface 232 that extends back so as to form a portion of a chamber 212', and a conical ramp surface 234 configured so as to slip around the canister 210' as the second end block 214' is installed into the second end insert 206. The ramp surface 234 serves to guide the canister 210' into slidable engagement with the chamber support surface 232, which in turn forms a portion of the chamber 212' that is sized to engage the canister 210' to maintain it axially aligned. Forming the ramp surface 234 with an angle of about 15° is felt to be effective in guiding the second end block 214' over the canister 210'. Further alignment of the canister 210' with the tube 202 is provided by a conical chamber rear surface 236 formed on the activating rod 230; the conical configuration of the chamber rear surface 236 acts to center either the canister 210 (shown in FIG. 8) or the canister 210' in the tube 202. Forming the chamber rear surface 236 with an angle of about 45° is felt to provide an effective centering action.

It should be noted that, where the canister 210' differs in length from the canister 210, the length of the activating rod 230 may need to be adjusted, or a spacer may need to be employed to allow the activating rod 230 to properly advance and thereby activate the canister 210'. In the embodiment shown, the tube 202 is fitted with a first end insert 228' which has a first end cap 238 threadably engaged therewith. The first end cap 238 is configured to support and slidably engage the activating rod 230.

The enlarged portion of FIG. 9 better illustrates the nozzle seat 216 and the nozzle recess 222 of the second end block 214', which are identical to those of the second end block 214 shown in FIG. 8. The nozzle recess 222 has a chamfered edge 240 that facilitates insertion of the nozzle 220 thereinto when the second end block 214' is screwed into the second end insert 206.

In addition to adapting the shaft 200 to different sizes of canisters (210, 210') by employing different second end blocks (214, 214'), the shaft 200 could be adapted to use a different deterrent by providing alternative second end blocks. Two examples are shown in FIG. 9. A second end block 214" is configured to threadably engage the second end insert 206, and is provided with a fluted point 242. The fluted point 242 provides a spear point, as employed in the shaft 14 discussed above and shown in FIGS. 2 and 3, but also provides edges 244 that may provide a cutting and/or slashing capability. Furthermore, if the second end block 214" is sufficiently heavy, it may serve to act as a bludgeon. One heavy material which is durable and provides good edge-holding ability is tungsten carbide. A second end block 214'" combines a fluted point 242' with the elements of the second end block 214' that allow it to form a chamber for the canister 210'. The second end block 214'" has a block passage 218' that extends through an apex 246 of the fluted point 242'.

Figure 10:
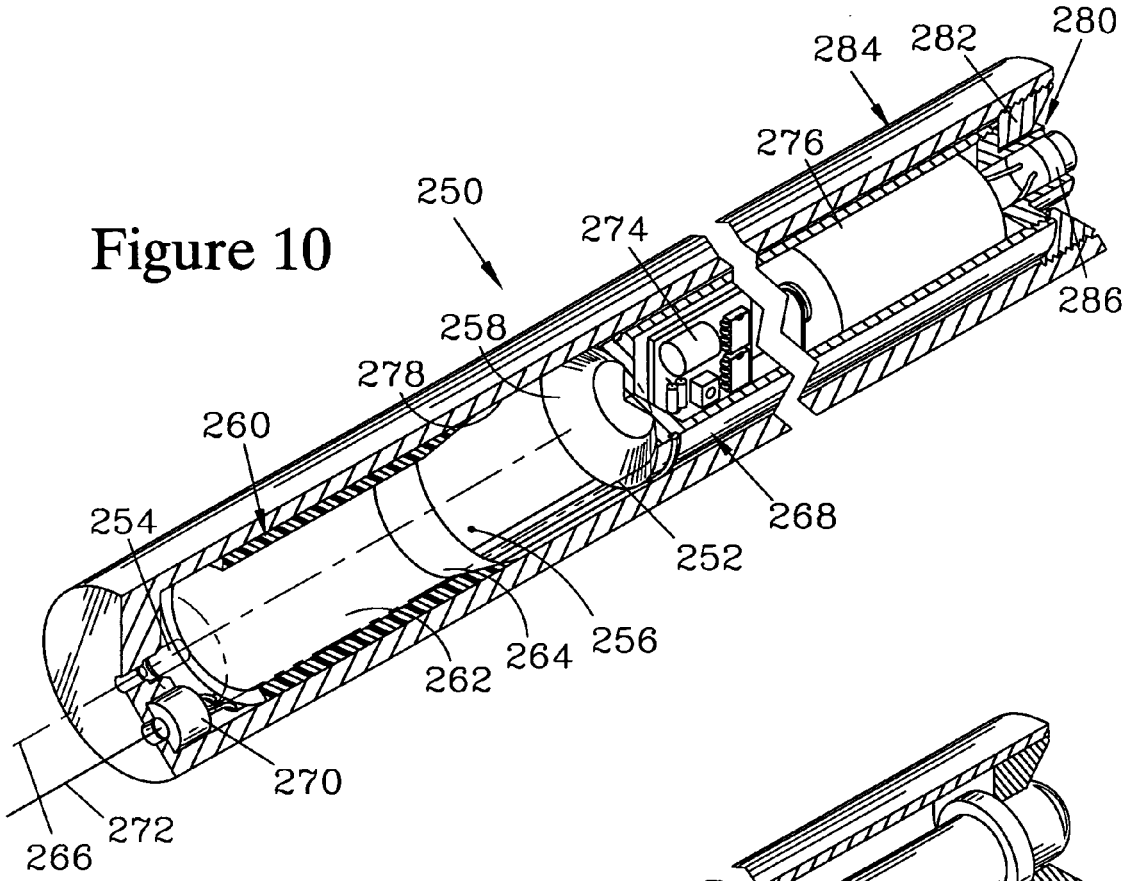
FIG. 10 is a section view of a shaft of another embodiment of the present invention, which is similar to the embodiment shown in FIG. 7, but where the canister is loaded with a gel irritant, rather than a liquid or gas. In this embodiment, alignment of the canister and nozzle is maintained by a chamber support surface and an essentially conical chamber rear surface so as to align the nozzle and canister with the shaft. A laser aiming device is provided in the second end block, and generates a light beam which is parallel to a longitudinal shaft axis of the shaft to aid the user in aiming the gel spray at a target.

FIG. 10 illustrates a shaft 250 which is similar to the shaft 150 shown in FIG. 7, but which is intended for use with a canister 252 (shown in phantom) that is loaded with an irritant gel. Again, the canister 252 has a nozzle 254 which opens a valve and releases the chemical irritant when advanced into the canister 252. The shaft 250 has a chamber 256 terminating at a chamber rear surface 258. A portion of the chamber 256 is defined by a chamber insert 260 which has a chamber support surface 262 and a ramp surface 264. The chamber support surface 262 defines a portion of the chamber 256 that is sized to be slidably engaged by the canister 252, so as to maintain the canister 252 aligned with a shaft axis 266 of the shaft 250. The ramp surface 264 acts to guide the canister 252 into alignment with the chamber support surface 262 when the canister 252 is inserted into the shaft 250. The canister 252 is also engaged and aligned by the chamber rear surface 258, which forms part of an activating rod 268 that serves to advance the canister 252 in the chamber 256. Again, the chamber rear surface 258 is concave when viewed from the chamber 256, and is preferably conical. It should be appreciated that other concave, symmetric surfaces could be employed, such as spherical surfaces. The chamber rear surface 258 is both concave and symmetric about the shaft axis 266 so as to engage the canister 252 to maintain the canister 252 aligned with the shaft axis 266 to facilitate aiming the spray from the nozzle 254.

While the use of a gel allows greater range, the increased range is due largely to reduced spread, which makes accurate targeting of the aggressor critical. To aid the user in targeting the aggressor, the shaft 250 houses a laser aiming device 270 that directs a beam of light 272 parallel to the shaft axis 266 and the direction of the stream of the gel so as to indicate the targeted region. The energy to operate the laser aiming device 270 is provided by a laser power circuit 274 which is powered by a battery 276, both of which are housed in the activating rod 268, which in turn is configured to slidably engage a sidewall 278 of the shaft 250. The activating rod 268 has a rod free end 280 which extends from a first end cap 282 which closes a first end portion 284 of the shaft 250. The rod free end 280 in turn is fitted with a pushbutton switch 286 that provides power from the battery 276 to the laser power circuit 274 to generate the beam of light 272 before the rod free end 280 is depressed so as advance the canister 252 and release a gel stream. Depressing the switch 286 causes the laser aiming device 270 to be activated, which may serve as sufficient deterrent to the aggressor since such aiming devices are frequently associated with firearms. If not, applying further pressure to the switch 286 causes the activating rod 268 to move, causing a stream of gel to be released from the canister 252, with the laser aiming device 270 allowing the user to readily see where the stream of gel is aimed.

Figure 11:
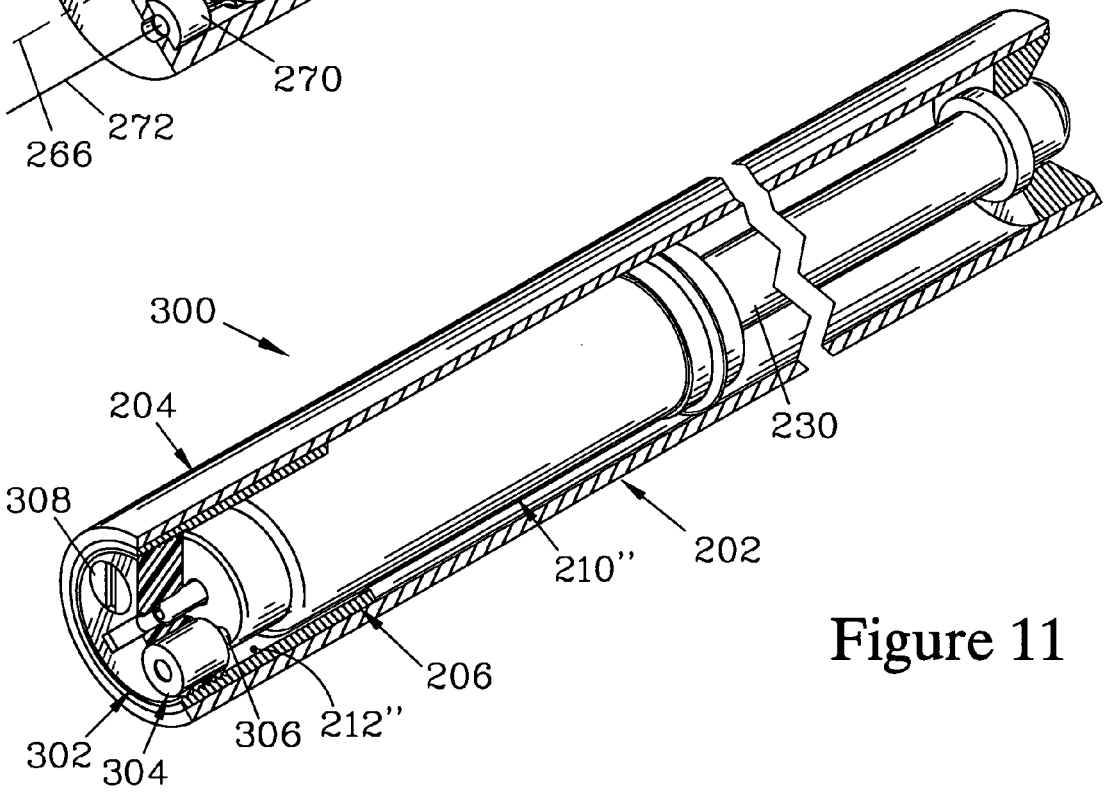
FIG. 11 is an isometric view of a shaft fashioned after the shaft shown in FIG. 10, but using the insert shown in FIG. 8.

FIG. 11 is an isometric view of a shaft 300 which shares many parts in common with the shaft 200 shown in FIGS. 8 and 9, but which is adapted to provide the functions of the shaft 250 shown in FIG. 10. In this embodiment, the shaft 300 is again formed using the tube 202 and the second end insert 206. However, the shaft 300 employs a second end block 302 which has a laser aiming device 304 incorporated therein. In this embodiment, the laser aiming device 304 is self-contained, having a switch stem 306 which extends into a chamber 212" when the second end block 302 is threadably secured into the second end insert 206. When the switch stem 306 is depressed, it provides power to the laser aiming device 304 from button cell batteries (not shown) that are also housed in the second end block 302. The batteries are retained by a battery cover 308 which is threadably attached to the second end block 302.

The laser aiming device 304 is positioned such that advancement of a canister 210" of irritant gel by the activating rod 230 causes the canister 210" to depress the switch stem 306, activating the laser aiming device 304. Preferably, activation of the laser aiming device 304 occurs before the canister 210" has been advanced sufficiently to open the valve to release the gel from the canister 210".

Figure 12:
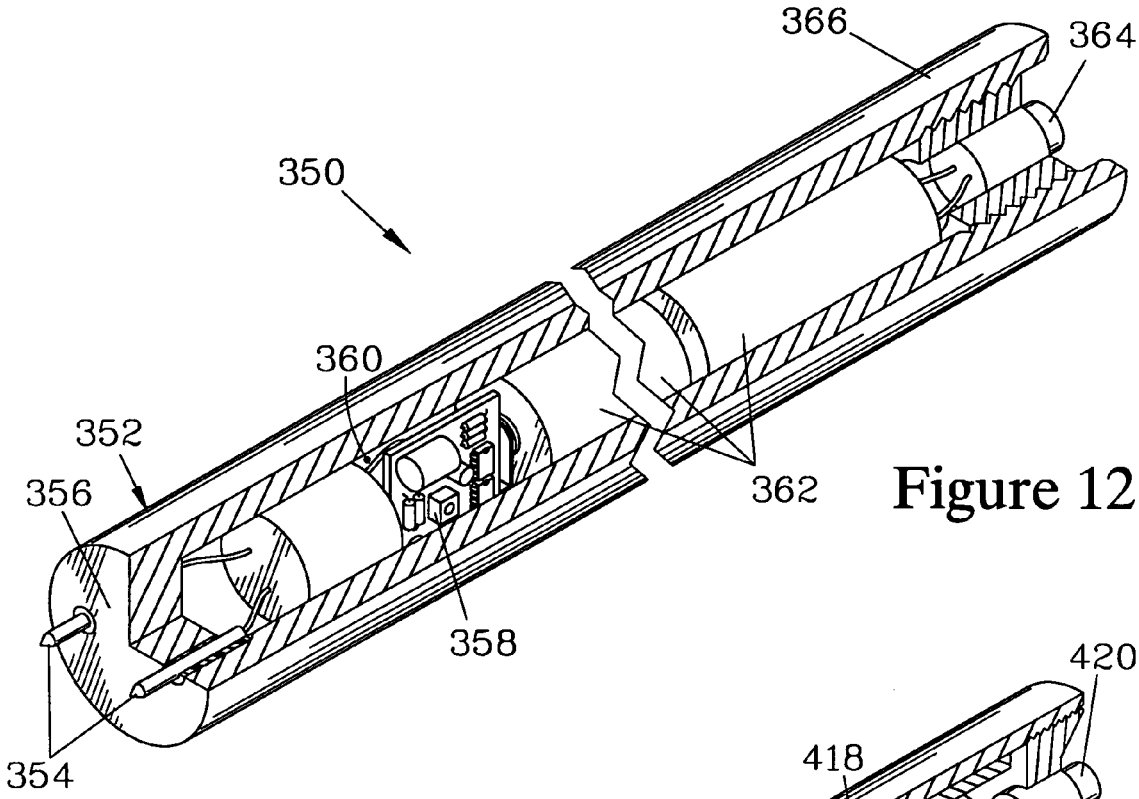
FIG. 12 is an isometric view showing a shaft that forms part of another embodiment of a personal protection system of the present invention. In this embodiment, a second end portion of a shaft is designed to prod the aggressor by providing an electrical discharge to shock the aggressor.

FIG. 12 is an isometric view that illustrates a shaft 350 that differs from the shafts (14, 50, 100, 150, 200, 250, and 300) discussed above, in part, in that the shaft 350 houses an appliance for generating an electrical deterrent. A second end portion 352 of the shaft 350 has a pair of spaced apart electrodes 354 extending therefrom. These spaced apart electrodes 354 pass through a second end block 356 and are connected to an electrical discharge circuit 358 which is housed in a central passage 360 of the shaft 350. Batteries 362 are also housed in the central passage 360 and connect to a switch 364 mounted so as to be exposed at a first end portion 366 of the shaft 350. When the switch 364 is closed by pressure applied by the user, power is provided from the batteries 362 to the electrical discharge circuit 358, which in turn generates a cyclic high voltage across the electrodes 354. The high voltage acts to disable the motor functions of the person contacted by the electrodes 354, so as to prevent that person from continuing any aggressive action. An arcing potential is sustained across the electrodes 354 while the switch 364 is depressed. It should be appreciated that a shaft having the function of the shaft 350 could be formed using the tube 200 and the second end insert 206 shown in FIGS. 8, 9, and 11, simply by providing different internal elements attached to a suitable second end block which threadably engages the second end insert 206. It should also be pointed out that, while disposable batteries are illustrated, the batteries 362 could be provided by one or more rechargeable batteries, in which case the shaft could be designed to allow the batteries to be recharged when the shaft is stored in the end bases.

Figure 13:
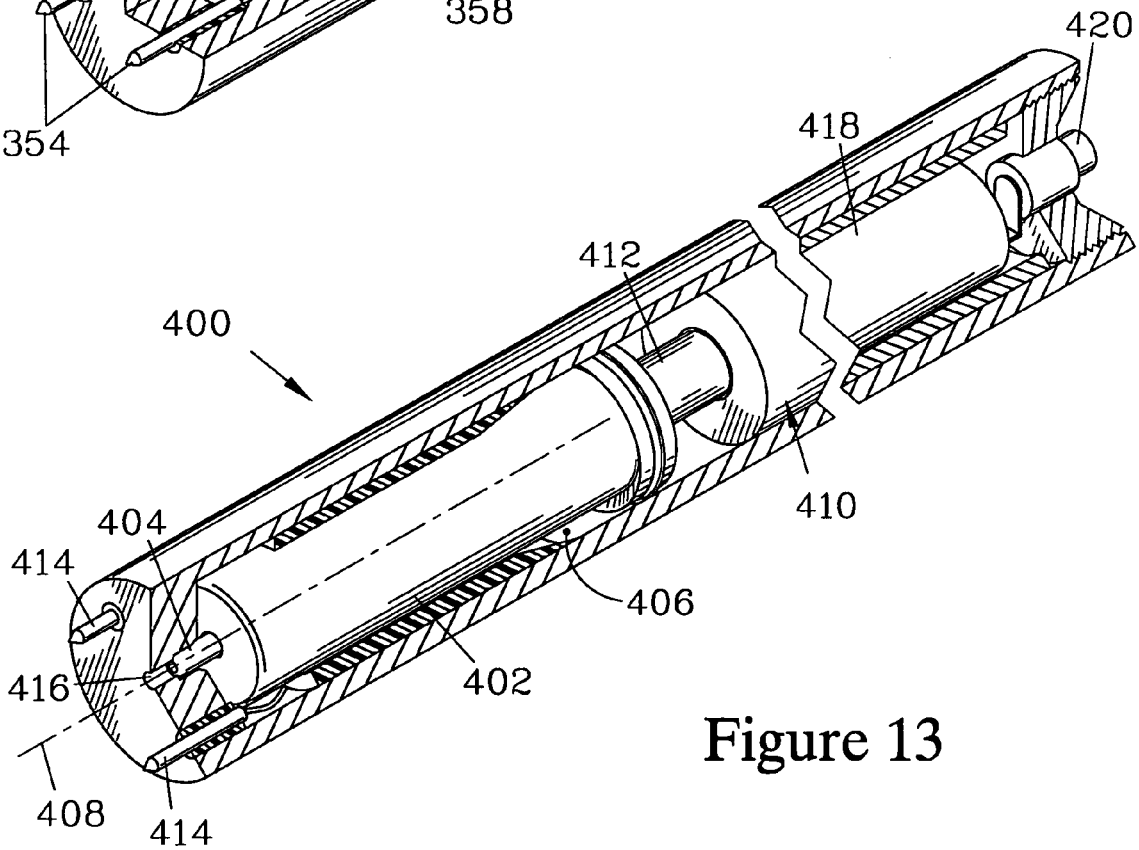
FIG. 13 is a section view of a shaft of another embodiment of the present invention, which combines the deterrent devices of the embodiments shown in FIGS. 7–11 and FIG. 12; the shaft employs a chemical spray as a primary deterrent, but also includes an electrical discharge device to provide a supplemental deterrent to be employed after the canister has been activated. In this embodiment, the canister is advanced by a solenoid. A power source and circuitry for controlling both the solenoid and the electrical discharge circuit in response to a switch are contained in the shaft.

FIG. 13 illustrates a shaft 400 which employs a chemical irritant spray in combination with a supplemental means for deterring an aggressor in the event that the chemical spray is not sufficient or misses its intended target. An irritant spray canister 402 with a nozzle 404 resides in a chamber 406 and is aligned with a shaft axis 408 in a manner similar to that employed in the embodiment shown in FIG. 10. In this embodiment, the canister 402 is advanced by a solenoid 410 which has an extendable activating rod 412 that engages the canister 402. In the event that the spray has been exhausted and the aggressor has not been turned away, then a supplemental deterrent is supplied by a pair of spaced apart electrodes 414 connected to an electrical discharge control circuit (which is not shown in FIG. 13). The electrodes 414 bracket a block passage 416 that communicates with the nozzle 404 and are positioned so as not to interfere with release of the spray from the nozzle 404. The solenoid 410 and the electrodes 414 are powered by batteries 418 (only one of which is shown) housed in the shaft 400. A two-stage pressure switch 420 is provided; when pressure is applied by the user, the switch 420 provides power first to the solenoid 410, then, with increasing pressure, to the electrodes 414. The use of the solenoid 410 allows the possibility of providing a remote cut-off device which would deactivate the shaft 400 to prevent use by unauthorized persons.

The following figures illustrate details of the interaction between the shaft and the end bases in several exemplary embodiments, this interaction providing the means for engaging and disengaging the shaft in the end bases. Typically, the engagement of one of the end portions with its associated end base allows the end portion to pivot slightly with respect to the end base. While such can be provided by making one of the base apertures oversized, as discussed above with regard to FIGS. 2 and 3, it is preferred for the end portion and the end base to provide a natural appearance, without unsightly or atypical gaps which might alert an observer to the fact that the disguised personal protection system is not simply a conventional object.

Figures 14, 15:
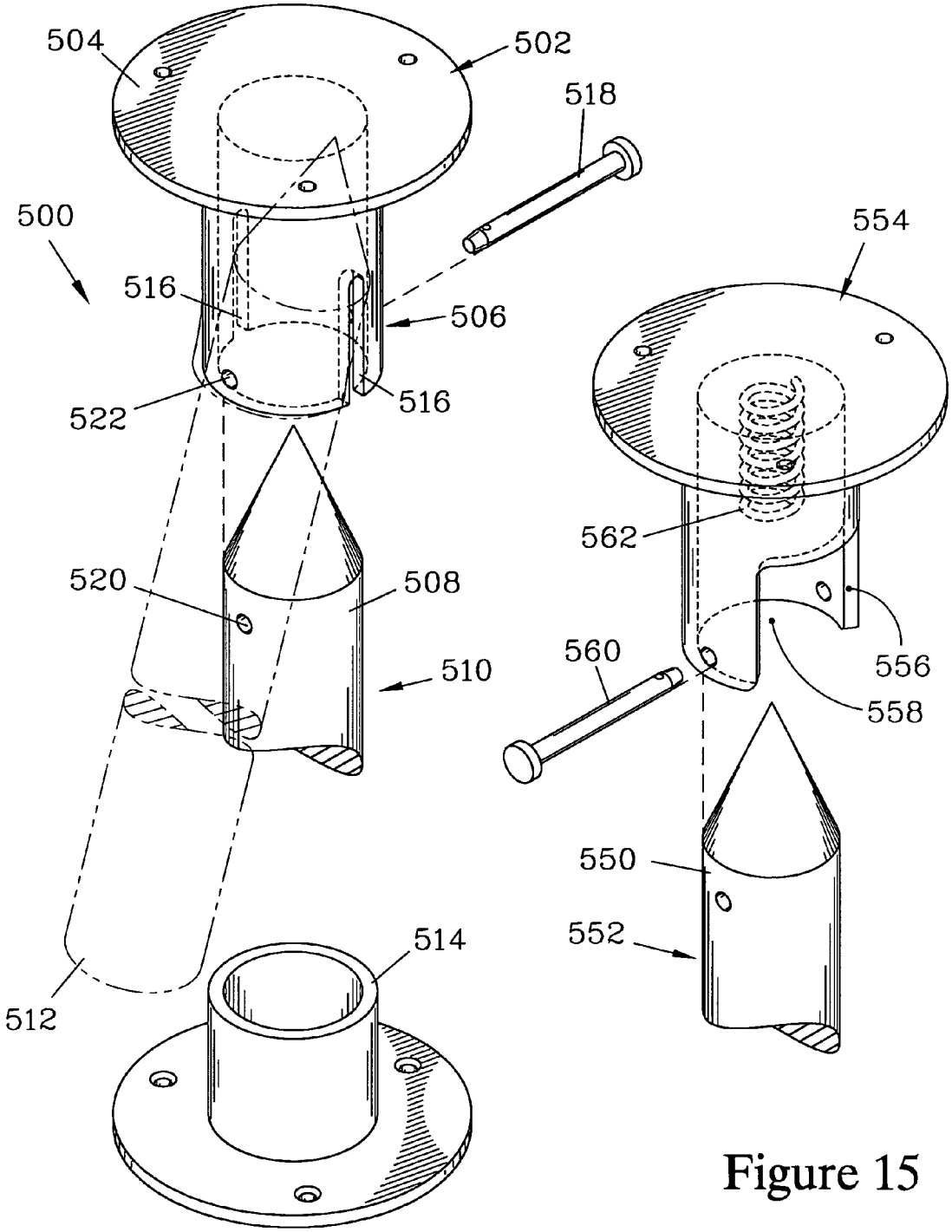
FIG. 14 is an exploded view of a portion of another embodiment of the present invention, where one of the end bases has a deformable sidewall which embraces the shaft and allows it to be tilted out of alignment with the other base, as indicated in phantom. Slots in the deformable wall further facilitate removal of the shaft.
FIG. 15 is an exploded view of a portion of another embodiment of the present invention, where one of the end bases has a "U" shaped opening to allow the shaft to be swung out of engagement with the other end base.

FIG. 14 is an exploded isometric view of a personal protection system 500, which illustrates a second end base 502 having a flange 504 with a sidewall 506 attached thereto and configured to slidably engage a second end portion 508 of a shaft 510 which bears many similarities to the deterrent device illustrated in FIGS. 2 and 3. However, in this embodiment, the sidewall 506 is formed of an elastically deformable material that allows the shaft 510, when advanced further into the second end base 502, to be swung as shown in phantom. This motion allows a first end portion 512 of the shaft 510 to be swung out of alignment with a first end base 514 so that the first end portion 512 of the shaft 510 will clear the first end base 514; this in turn allows the second end portion 508 to be withdrawn from the second end base 502. Having an elastically deformable sidewall 506 eliminates the need to provide a gap G such as is employed in the embodiment illustrated in FIGS. 2 and 3. Slots 516 can be provided in the sidewall 506 to allow greater deformation of the sidewall 506 to help assure that the second end portion 508 of the shaft 510 can be tilted in the second end base 502 sufficiently to move the first end portion 512 out of alignment with the first end base 514. While the deformability of the sidewall 506 allows removal of the shaft 510 without the need for a large gap between the shaft 510 and the sidewall 506, employing the slots 516 may again create an abnormal appearance. A pull pin 518 passes through a shaft passage 520 and a base passage 522 and serves to secure the shaft 508 in the bases (502, 514) until needed.

FIG. 15 illustrates another means for engaging and disengaging an end portion 550 of a shaft 552 with a base 554, which again allows the end portion 550 of the shaft 552 to be tilted in the base 554 to aid in removal. In this embodiment, the base 554 has a "U" shaped opening 556 that opens a portion of a base aperture 558. The "U" shaped opening 556 allows the shaft 552 to be advanced further into the base aperture 558 and then readily pivoted out of engagement with the other end base (not shown) when a pull pin 560 is removed.

FIG. 15 also illustrates an ejection spring 562 which can be housed in the end base 554 to aid in removing the end portion 550 once the other end portion has been swung out of alignment with its associated end base. The ejection spring 562 provides a biasing force that tends to push the end portion 550 out of the base aperture 558.

It should be appreciated that another approach to provide a more natural appearance can be achieved if the shaft itself is sufficiently flexible that the first end portion can be bent out of alignment with the first end base even if the second end base is rigid. Such flexibility of the shaft is particularly feasible when the shaft is formed from relatively thin-walled tubing, such as the tube 202 shown in FIGS. 8, 9, and 11, and has the advantage that the end bases can have a more conventional appearance.

Figure 16:
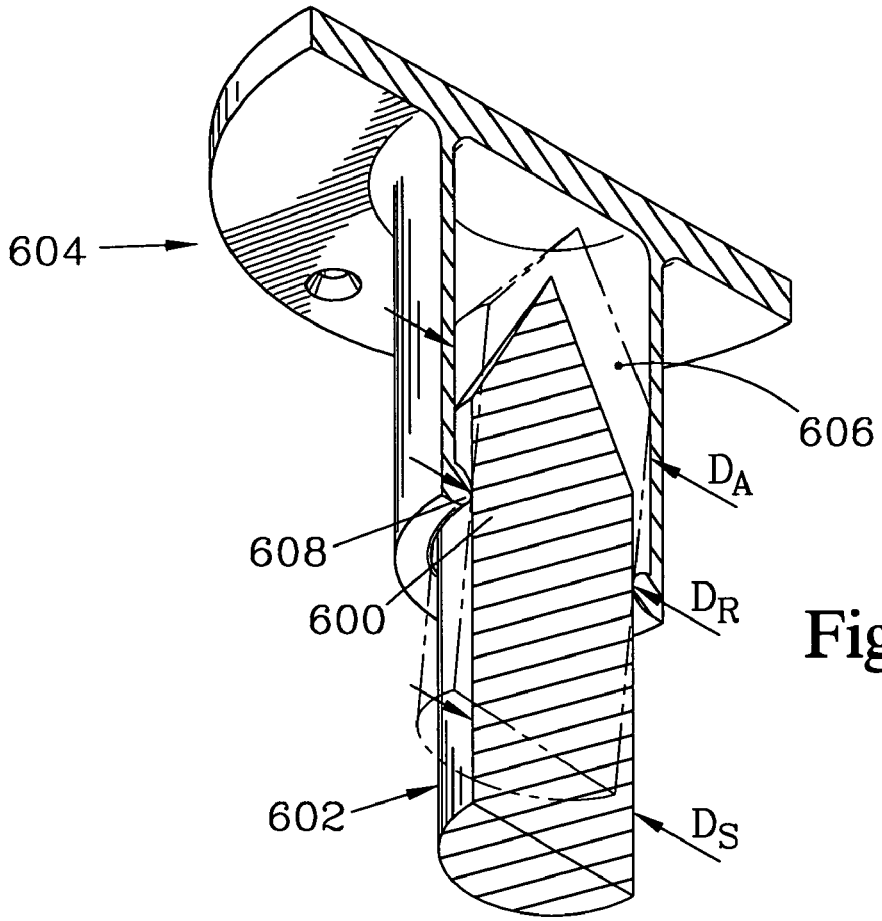
FIG. 16 is a section view of a portion of another embodiment of the present invention, where one of the bases has a ring which engages a corresponding end portion of the shaft so as to restrain the shaft but to allow it to pivot so that the shaft can be swung out of the other base.

While the use of flexible or deformable materials as discussed above can provide a more natural appearance for the personal protection system, in some applications it may be desirable to use rigid materials to assure that the personal protection system provides sufficient support for users. FIG. 16 is a section view illustrating another means for engaging and disengaging an end portion 600 of a shaft 602 with an end base 604 in such a manner as to allow the end portion 600 to be tilted in the base 604 to bring the other end portion (not shown) out of alignment with its associated end base in the same manner as is illustrated in FIG. 14; however, in this embodiment the shaft 602 and the end base 604 can be rigid. The base 604 of this embodiment has a base aperture 606 that is larger in diameter than the end portion 600 of the shaft 602. To prevent a readily visible gap, an inwardly-directed ring 608 is provided to fill the space between the base 604 and the shaft 602. The ring 608 creates a reduced diameter $D_R$ of the base aperture 606, while the remainder of the base aperture 606 has a larger diameter $D_A$. The end portion 600 has a shaft diameter $D_S$ which is only slightly less than the reduced diameter $D_R$, allowing the ring 608 to snugly engage the end portion 600. This provides support for the shaft 602 as well as helping to disguise the fact that the shaft 602 is removable. When the shaft 602 is slid upwards so as to disengage the other end portion from its associated end base, the larger aperture diameter $D_A$ of the base aperture 606 allows the shaft 602 to then be tilted (as shown in phantom) until the other end portion is no longer aligned with its associated end base. The shaft 602 can then be slid out of engagement with the base 604.

Figure 17:
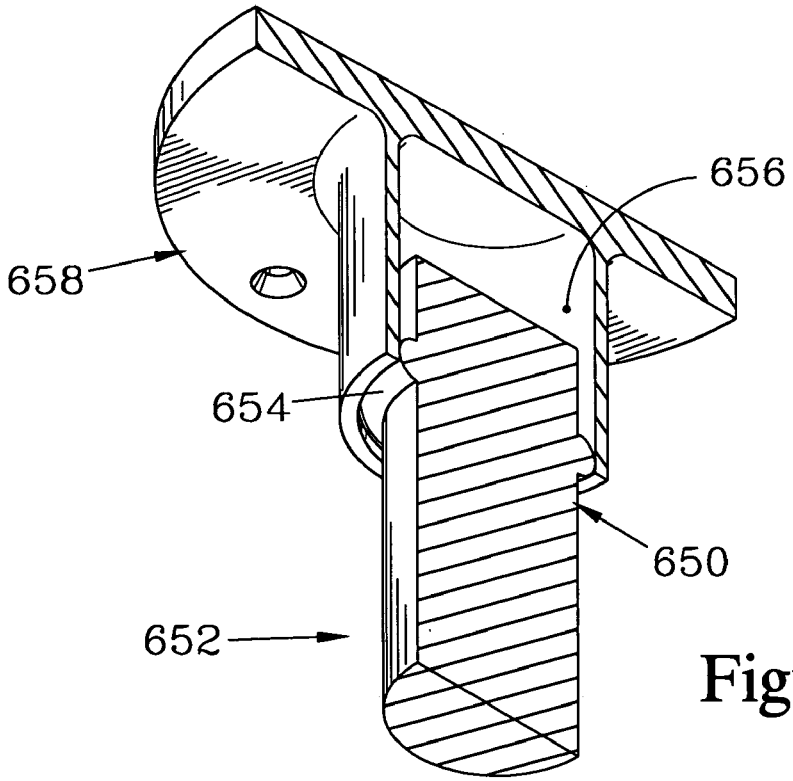
FIG. 17 is a section view of a portion of another embodiment, which employs a shaft end portion and a corresponding base that are functionally similar to those shown in FIG. 16. In this embodiment, the end portion of the shaft is provided with a ring which engages a corresponding aperture in the base so as to restrain the shaft but allow it to be swung in and out of engagement with the other base.

FIG. 17 is a section view of a portion of another embodiment, where an end portion 650 of a shaft 652 is provided with an outwardly-protruding ring 654 which engages a corresponding base aperture 656 of a base 658. The ring 654 allows the base 658 to supportably engage the shaft 652, while allowing the shaft 652 to be swung in and out of the base 658 in a manner similar to that discussed above for the embodiment shown in FIG. 16.

As discussed above, it is preferred for the personal protection system to have the appearance of a conventional fixture. Thus, when the shaft is to be lockably engaged with the end bases, it is preferred for the end bases to be configured so as to conceal the locking means, thereby providing a more natural appearance than is achieved using pull pins, such as those shown in FIGS. 2, 3, 14, and 15. The following figures illustrate some examples of concealed locking means which could be employed to secure one end of a shaft in a base; these means would be well suited for use in combination with one of the pivotable engagement schemes discussed above at the other end of the shaft.

Figure 18:
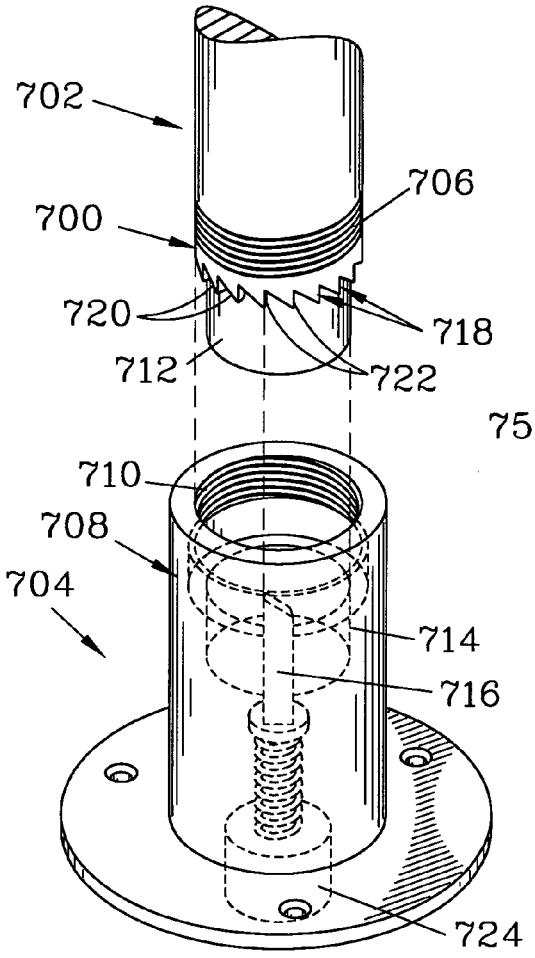
FIG. 18 is a partial view of another embodiment of the present invention; in this embodiment, one end portion of the shaft is threadably engaged with a corresponding end base. When the threads are tightened, the shaft is securely fitted in the base; however, the shaft could be loosened in service if used as a grip bar. In this embodiment, the shaft is locked to the base by a spring-loaded pawl which engages a toothed profile of the shaft which is configured so as to allow the shaft to be turned only in the direction to tighten the threadable engagement. The pawl can be retracted by a servo to allow the shaft to be loosened. A remote hand-held bob, similar as to those used to lock and unlock automobile doors, can be used to control the servo.

FIG. 18 illustrates a means for engaging and disengaging an end portion 700 of a shaft 702 with an end base 704 which provides a lockable engagement where the locking elements are not apparent when the shaft 702 is secured to the end base 704. The end portion 700 has a shaft threaded section 706, while the end base 704 has a base sidewall 708 with a sidewall threaded section 710 configured to threadably mate with the shaft threaded section 706. The threading should be relatively coarse so as to allow a quick release. When the shaft 702 is to serve a support function, then it is preferred to have a mechanical lock that needs to be released before the shaft 702 can be turned in a direction so as to loosen the threadable engagement. To allow the user to readily align the end portion 700 with the end base 704 to engage the threaded sections (706, 710), it is preferred for the end portion 700 to include a reduced guide section 712 that is configured to slidably and rotatably engage a base aperture reduced section 714.

In this embodiment, the mechanical lock is provided by a combination of a spring-loaded pawl 716 which is positioned to engage a series of teeth 718 located on the end portion 700 of the shaft 702. Each tooth 718 is configured to provide a ramp surface 720 which faces the direction of rotation when the shaft is being tightened. With the teeth 718 so configured, the spring loaded pawl 716 follows the ramp surfaces 720 when the shaft 702 is tightened, but blocks reverse turning of the shaft 702 by engaging blocking faces 722 that are provided on the teeth 718. Thus, to reverse the direction of turning to loosen the shaft 702, the pawl 716 must be retracted from engagement with the teeth 718. Such can be readily done by a servo mechanism 724. The servo mechanism 724 could be activated by a switch at a remote location, but more preferably is activated by a hand-held remote control such as a radio controller or a controller using bluetooth technology. For example, FIG. 18 shows a bob 726 on a key ring that could be used to allow one to either block or allow rotation of the shaft 702. Similar remote control technology could be employed in the embodiments discussed above which employ electrical discharge deterrents to deactivate these deterrent devices unless such are remotely activated by authorized personnel.

Figure 19:
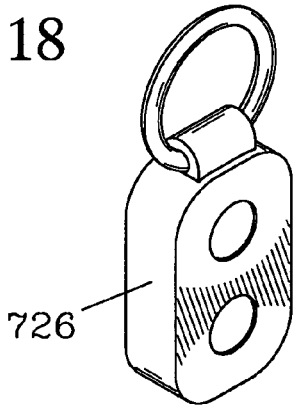
FIG. 19 is a partial isometric view of another embodiment of the present invention where a bayonet coupling is used to secure a shaft in one of the bases, thus allowing quick release of the shaft without the shaft being subject to inadvertent loosening.
Figure 19:
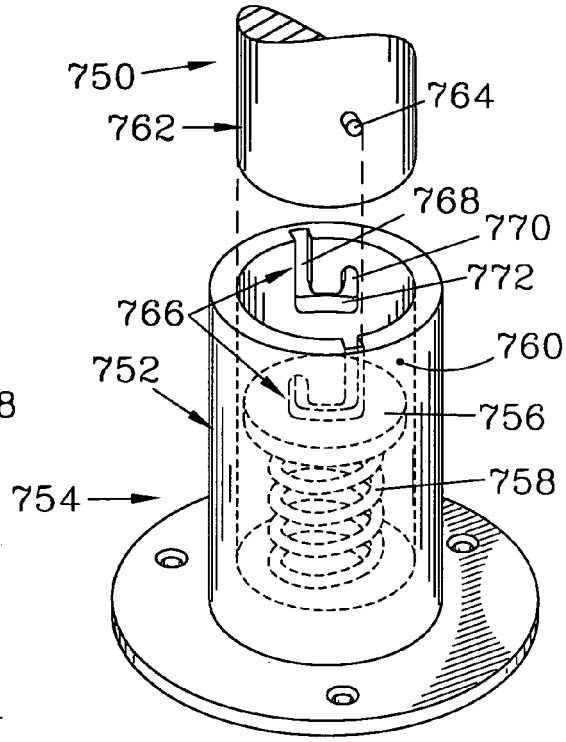

FIG. 19 is a schematic illustration of a bayonet connection to form a securable/releasable connection between a shaft 750 and a sidewall 752 of an end base 754. The sidewall 752 is employed in combination with a base plate 756 which is biased by a spring 758; when the spring 758 is compressed, the combined sidewall 752 and base plate 756 provide a cavity 760 for housing an end portion 762 of the shaft 750. The end portion 762 is provided with a pair of pins 764 (only one of which is visible in FIG. 19) which extend from the end portion 762 and are sized such that they can each engage a "J"-shaped slot 766 in the sidewall 752. Aligning the pins 764 with the slots 766 allows the end portion 762 to be partially slid into the cavity 760. When the force is sufficient to overcome the bias of the spring 758, the pin 764 can be moved along a long leg 768 to a bottom segment 770 of the slot 766, and thereafter be turned to align with a short leg 772 of the slot 766. At this point, upon release of the pressure, the pin 764 becomes seated in the end of the short leg 772 and thus the shaft 750 is not subject to turning when twisted. As with the threaded embodiment shown in FIG. 18, the turning of the shaft 750 in the base 754 could be blocked by a solenoid device to prevent removal of the shaft by unauthorized persons. The bayonet connection illustrated has an advantage over the threaded embodiment shown in FIG. 18 in that it is more easily fabricated and requires less precise fit between the mating elements.

Figure 20:
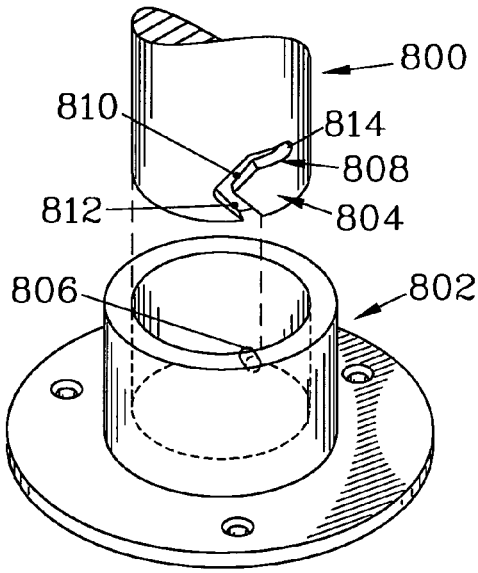
FIG. 20 is a partial view of an alternative bayonet-type mounting which can be employed where reduced protrusion of the shaft into the base is desired.

FIG. 20 illustrates an alternative bayonet-type coupling which does not require a shaft 800 to extend as far into an end base 802 as does the embodiment shown in FIG. 19. In this embodiment, the shaft 800 is biased by a compression spring in the other end base (not shown) and is provided with an angled slot 804. The end base 802 has a pin 806 configured to engage the angled slot 804. The angled slot 804 has a circumferential segment 808, a first inclined segment 810, and a second inclined segment 812. When the shaft 800 is stored, the pin 806 is positioned at a closed end 814 of the circumferential segment 808. To release the shaft 800, the user rotates the shaft 800 to move the pin 806 to the junction between the circumferential segment 808 and the first inclined segment 810 (this rotation is counterclockwise as viewed looking toward the end base 802). At this point, the user must apply force to the shaft 800 while continuing to rotate it to overcome the bias of the compression spring and move the pin 806 along the first inclined segment 810 to the junction between the first inclined segment 810 and the second inclined segment 812. To release the shaft 800, the user must then rotate the shaft 800 in the other direction (clockwise as viewed looking toward the end base 802) while continuing to apply force against the bias spring to move the pin 806 along the second inclined segment 812 to exit the angled slot 804. The requirement that the user apply force while rotating the shaft 800 subsequently in two different directions prevents accidental release of the shaft 800 when used for a supporting function while stored.

Figure 21:
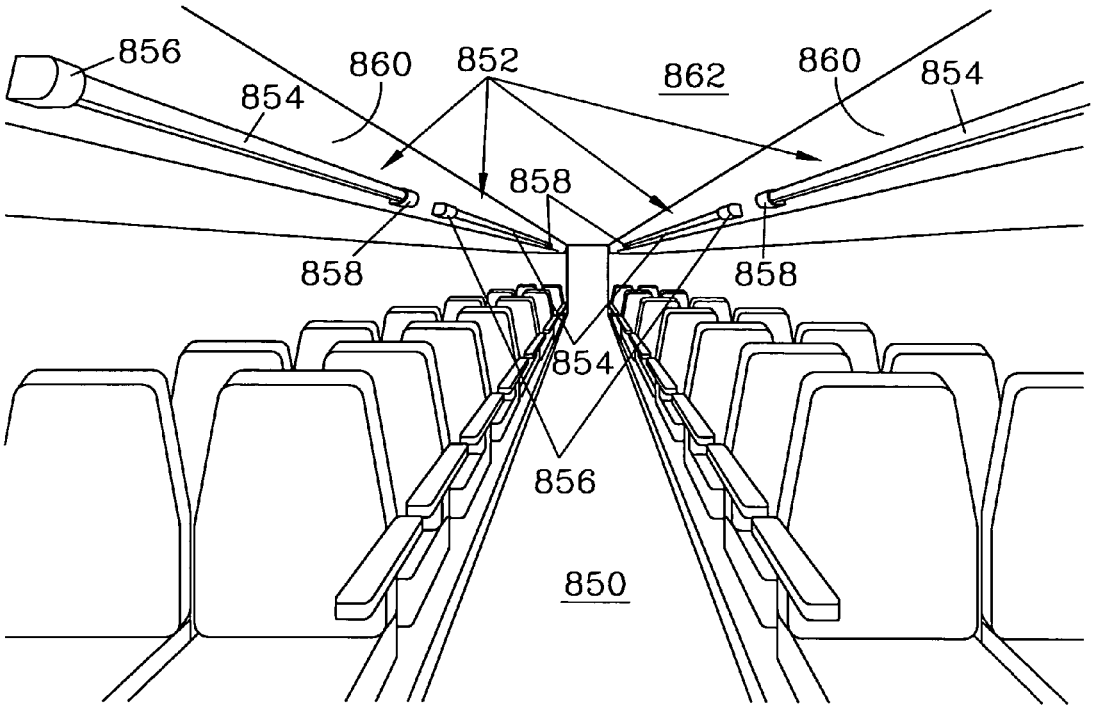
FIG. 21 is a perspective view illustrating one embodiment of a personal protection system of the present invention, where the personal protection system serves as a hand rail such as is frequently provided on a bus.

FIG. 21 is a perspective view of a section of an airplane cabin 850 which has installed therein a series of personal protection systems 852 of one embodiment of the present invention. In this embodiment, the personal protection systems 852 each have a shaft 854 which, in turn, is removably mounted in a first end base 856 and a second end base 858. The bases (856, 858) mount to fixed surfaces 860 located in an upper section 862 of the airplane cabin 850; the shafts 854, in combination with the bases (856, 858), form a natural extension of the cabin 850 and appear to be conventional air turbulence bars and become part of the background in which a flight attendant operates. However, each of the shafts 854 can be removed from the associated bases (856, 858) to provide a tool for use by the flight attendant to fend off an aggressor.

Figure 22:
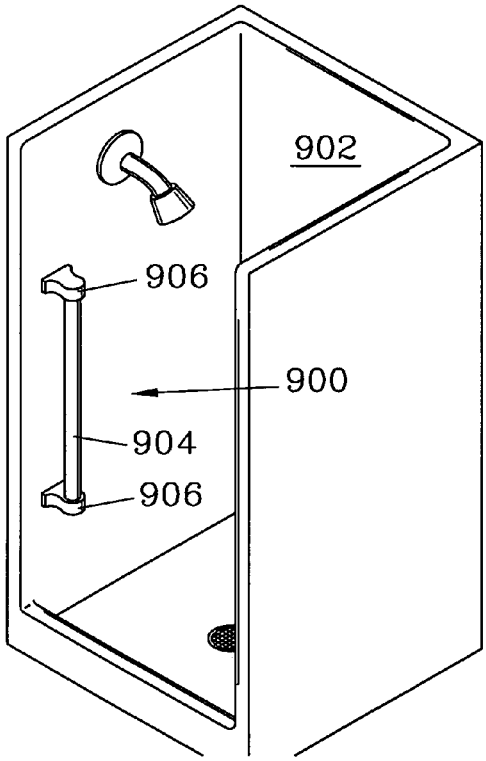
FIG. 22 is an isometric view showing an embodiment of the present invention where the countermeasure is installed in a shower stall and, in general service, serves as a safety bar.

FIG. 22 is an isometric view showing a personal protection system 900 which forms an embodiment of the present invention which is configured to be installed in a shower stall 902. The personal protection system 900 has a shaft 904 and a pair of bases 906. The bases 906 mount to the shower stall 902 and supportably engage the shaft 904 so that it can serve as a safety bar.

Figure 23:
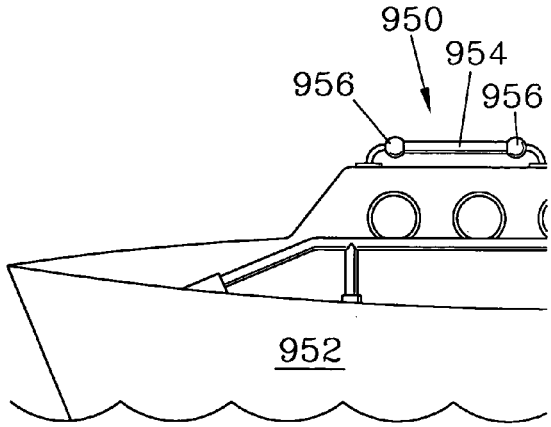
FIG. 23 is an elevation view showing an embodiment of the present invention where the countermeasure system is installed on a boat and in, general service, serves as a grab rail.

FIG. 23 is an elevation view showing a personal protection system 950 which forms an embodiment of the present invention which is configured to be installed on a boat 952. The personal protection system 950 has a shaft 954 and a pair of bases 956, the bases 956 mounting to the boat 952 and supporting the shaft 954. The shaft 954 is lockably and removably engaged with the bases so that the shaft 954 can serve the dual capacity of a grab rail and a deterrent device. For such applications, the bases 956 are configured to resemble conventional nautical fittings. It is preferred in such applications for the personal protection system 950 to employ only mechanical elements for providing a deterrent and for lockably engaging the shaft 954 to the end bases 956, due to the susceptibility of electronic elements to corrosion when exposed to a marine environment. Furthermore, when a chemical irritant is employed, a gel is preferred since a gel is less susceptible to being misdirected by wind.

While the novel features of the present invention have been described in terms of particular embodiments and preferred applications, it should be appreciated by one skilled in the art that substitution of materials and modification of details obviously can be made without departing from the spirit of the invention.

What we claim is:

1. A personal protection system to aid a user in warding off an aggressor, the personal protection system mounting onto one or more surfaces defining surroundings in which the user operates, the personal protection system being so configured as to appear to be a natural part of the surroundings and comprising:

a shaft having a first end portion adapted to be held by the user and a second end portion configured to form a prod for deterring the aggressor;

a first end base for attachment to one of the one or more surfaces, said first end base having a first base aperture configured to accept said first end portion of said shaft;

a second end base for attachment to one of the one or more surfaces, said second end base having a second base aperture configured to accept said second end portion of said shaft, said shaft, said first end base, and said second end base being configured so as to form a natural-appearing extension of the one or more surfaces so as to become part of a background in which the user is operating; and means for engaging and disengaging said shaft in said first end base and said second end base with advancing and tilting action of said shaft such that, when said shaft is engaged in said end bases, said shaft and said end bases transition so as not to interrupt the visual continuity of the surroundings.

2. The personal protection system of claim 1 wherein one of said end portions is accepted in a corresponding base aperture with a pivotable action therebetween.

3. The personal protection system of claim 2 wherein said pivotable action is provided with the cooperation of a ring that is interposed between said one of said end portions about which said shaft is pivoted and said corresponding base aperture, said ring being attached to one of said one of said end portions and said corresponding base aperture.

4. The personal protection system of claim 2 further comprising:

a compression spring mounted in said one of said base apertures to aid in removing said corresponding end portion out of said one of said base apertures.

5. The personal protection system of claim 1 further comprising:

a releasable locking device for securely engaging said shaft in at least one of said end bases so as to limit rotation of said shaft in said at least one of said end bases.

6. The personal protection system of claim 5 wherein said releasable locking device for securely engaging said shaft provides a lockable engagement and is selected from:

a pull pin engaging passages through one of said end portions and a corresponding one of said end bases;

threadable engagement between one of said end portions and a corresponding one of said apertures in combination with locking means to prevent rotation of said one of said end portions in said corresponding one of said apertures; and a bayonet coupling between one of said end portions and a corresponding one of said apertures.

7. The personal protection system of claim 3 wherein the other of said apertures and the other of said end portions can be secured together by a bayonet coupling.

8. The personal protection system of claim 3 wherein said prod has a point for piercing the aggressor.

9. The personal protection system of claim 3 which cooperates with a needle and syringe to ward off the aggressor wherein said prod has a telescoping section extending said second end portion of said shaft, said telescoping section having a cavity which houses the needle and a portion of the syringe therein, further wherein said telescoping section further comprises:

means for collapsing said telescoping section such that, when the needle and the syringe are contained in the personal protection system, the needle extends beyond said second end portion so as to provide exposure of the needle for piercing the aggressor; and means for injecting the contents of the syringe into the aggressor when the needle is extended beyond said second end portion.

10. The personal protection system of claim 3 further comprising:

an appliance for generating a deterrent, and further wherein said shaft further comprises:

means for housing said appliance for generating a deterrent;

means for communication of the deterrent through said second end portion of said shaft and therebeyond; and means for activating the deterrent.

11. The personal protection system of claim 10 wherein said means for activating the deterrent is accessible to the user at said first end portion of said shaft.

12. The personal protection system of claim 10 wherein said appliance for generating a deterrent generates a deterrent selected from the group of:

electrical discharge; and chemical irritants.

13. The personal protection system of claim 12 wherein said means for housing is configured to hold at least one battery and further wherein said means for communication of the deterrent through said second end portion and therebeyond further comprises:

a pair of spaced apart electrodes positioned in the second end portion of said shaft and protruding therefrom for discharging when said pair of electrodes are brought into close proximity or contact with an aggressor; and still further wherein said appliance further comprises:

a circuit to provide a pulsed voltage to said pair of electrodes; and yet further wherein said means for activating the deterrent further comprises:

a switch in said first end portion to provide power from the at least one battery to said circuit, said switch being so positioned as to be concealed by said first end base when said shaft is engaged therewith.

14. The personal protection system of claim 10 wherein said appliance to generate a deterrent is provided by a canister and nozzle assembly having, a nozzle with a nozzle axis, a canister containing a chemical irritant, and a release mechanism associated with said nozzle that can be activated to direct a spray of said irritant from said nozzle along said nozzle axis when said nozzle is advanced into said canister, wherein said means for housing said appliance further comprises:

a chamber in said second end portion of said shaft configured to hold said canister and nozzle assembly;

further wherein said means for communication of the deterrent through said second end portion and therebeyond further comprises:

a second end block for terminating said chamber at said second end portion, said second end block having a block passage disposed about a shaft axis;

still further wherein said means for activating the deterrent further comprises:

means for aligning said nozzle axis with said shaft axis;

a nozzle seat on said second end block configured to engage said nozzle to limit motion of said nozzle; and means for advancing said canister in said chamber so as to activate said release mechanism of said nozzle.

15. The personal protection system of claim 14 wherein said means for advancing said canister in said chamber so as to activate said release mechanism of said canister and nozzle assembly further comprises:

an activating rod terminating in a chamber rear surface and being configured to slide within said shaft;

means for maintaining alignment of said activating rod with said shaft;

means for advancing said chamber rear surface towards said second end portion of said shaft; and further wherein said canister is cylindrical and symmetrically disposed about said nozzle axis, said means for aligning said nozzle axis with said shaft axis further comprising:

a chamber support surface defining a portion of said chamber and being sized to be slidably engaged by said canister; and said chamber rear surface having a configuration that is essentially conical, axially aligned with said shaft axis, and forming a concave surface for engaging said canister.

16. The personal protection system of claim 15 wherein said means for advancing said chamber rear surface further comprises:

a free end terminating said activating rod, said free end extending through said first end portion of said shaft and being exposed so as to allow the user to manually advance said activating rod.

17. The personal protection system of claim 16 further comprising:

a blowback seal between said chamber and said first end portion.

18. The personal protection system of claim 17 wherein said shaft further comprises:

a tube that defines said shaft and terminates in said first end portion and said second end portion;

a second end insert having an outer diameter such that it will slidably engage said tube and being suitable for adhesively attaching to said second end portion of said shaft, said second end insert having an internal diameter sufficient to pass said canister therethrough and being configured to securely engage said second end block.

19. The personal protection system of claim 1 which cooperates with a canister and nozzle assembly to ward off the aggressor, wherein said shaft has a shaft axis and accommodates the canister and nozzle assembly therein, the canister and nozzle assembly having, a nozzle having a nozzle axis, a canister containing a chemical irritant, and a release mechanism associated with the nozzle that can be activated to direct a spray of the irritant from the nozzle along the nozzle axis when the nozzle is advanced into the canister, said shaft further comprising:

a chamber in said second end portion to house the canister and nozzle assembly;

a second end block for terminating said chamber at said second end portion of said shaft, said second end block having a block passage disposed about said shaft axis;

means for aligning the nozzle axis with said shaft axis; and means for activating the release mechanism of the nozzle.

20. The personal protection system of claim 19 wherein said means for aligning the nozzle axis with said shaft axis further comprises:

an essentially conical chamber rear surface of said chamber, and further wherein said means for activating the release mechanism of the nozzle further comprises:

a nozzle seat formed on said second end block and configured to engage the nozzle to limit motion of the nozzle; and means for advancing said chamber rear surface to advance the canister toward said nozzle seat.

* * * * *